US006297746B1

(12) United States Patent
Nakazawa et al.

(10) Patent No.: US 6,297,746 B1
(45) **Date of Patent: *Oct. 2, 2001**

(54) CENTRALIZED APPARATUS CONTROL SYSTEM FOR CONTROLLING A PLURALITY OF ELECTRICAL APPARATUSES

(75) Inventors: Tsutomu Nakazawa, Isesaki; Osamu Ishikawa, Fukaya; Kouichi Hamakawa, Gunma-ken; Ryouichi Watanabe, Ota; Takao Suzuki, Gunma-ken, all of (JP)

(73) Assignee: Sanyo Electric Co., Ltd. (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/240,540

(22) Filed: Jan. 29, 1999

(30) Foreign Application Priority Data

Jan. 30, 1998 (JP) ..... 10-020067
Jan. 30, 1998 (JP) ..... 10-020068

(51) Int. Cl.[7] ..... G08C 19/00

(52) U.S. Cl. ..... 340/825.69; 340/310.06; 340/310.08; 340/505; 340/514; 340/506

(58) Field of Search ..... 340/825.69, 825.72, 340/825.22, 310.01, 310.06, 310.08, 506, 505, 514

(56) References Cited

U.S. PATENT DOCUMENTS 4,728,949 * 3/1988 Platte et al. ..... 340/825.69
5,051,720 * 9/1991 Kittirutsunetorn ..... 340/310.07
5,086,385 * 2/1992 Launey et al. ..... 340/825.37
5,815,086 * 9/1998 Ivie et al. ..... 340/825.52
5,838,226 * 11/1998 Houggy et al. ..... 340/310.01
5,909,183 * 6/1999 Borgstahl et al. ..... 340/825.22

* cited by examiner

*Primary Examiner*—Donnie L. Crosland
(74) *Attorney, Agent, or Firm*—Cantor Colburn LLP

(57) ABSTRACT

There is disclosed a system for centrally controlling a plurality of electrical apparatuses in which radio communication is performed between a host unit and terminal units registered in the host unit and each terminal unit is disposed for each of the plurality of electrical apparatuses. The terminal unit controls the corresponding electrical apparatus based on a control signal from the host unit by the radio communication, and detects the state of the electrical apparatus to report it to the host unit. The radio communication is not directly performed between each electrical apparatus and the host unit, and the terminal unit is interposed therebetween, so that the radio communication is performed between a centralized control device and a terminal device. Therefore, electrical apparatus do not require a radio transmitter/receiver mechanism, and is only provided with a function by which data can be exchanged the terminal unit. When the electrical apparatus is non-applicable to the system, a power supply control unit is provided for controlling a power supply of the electrical apparatus, and connected to the corresponding terminal unit, so that the power supply of the electrical apparatus non-applicable to the system is controlled by controlling the power supply control unit via the terminal unit.

29 Claims, 20 Drawing Sheets

SYSTEM STRUCTURE

CENTRALIZED APPARATUS CONTROL SYSTEM FOR CONTROLLING A PLURALITY OF ELECTRICAL APPARATUSES

BACKGROUND OF THE INVENTION

1. Field of the Invention

The present invention relates to a system for centrally controlling a plurality of various types of electrical apparatuses such as lighting apparatuses, air conditioners, television sets, and the like by radio communication.

2. Description of the Prior Art

With the prevalence of various convenient and inexpensive electrical apparatuses, many houses or offices currently contain air conditioners, electric stoves and other heating apparatuses, various cooking apparatuses, television sets, cassette recorders with radios, videocassette recorders, stereo sets and other audio-visual apparatuses, as well as many other electrical apparatuses. However, it is natural to want to individually control these electrical apparatuses. Even if a remote controller or the like is provided, one must go to a place where each apparatus is situated to perform control with a dedicated controller. As the number of electrical apparatuses is increasing, for example, more time is required for turning on the power of each electrical apparatus, setting an operation timer, and turning off the power of unnecessary electrical apparatus, and the number of remote controllers is also increased.

In the circumstances, a home automation system for controlling a multiplicity of electrical apparatuses in a centralized manner has been proposed.

On the other hand, a security system is realized in which in order to monitor security in houses or offices, various sensors are installed indoors and outdoors to perform remote centralized control of smoke or flame detectors, invader detectors, and the like.

In the ordinary centralized control system, however, since control signals are directly exchanged between a control object or electrical apparatus and a centralized control device, the electrical apparatus to be incorporated in the system must be provided beforehand with an exclusive system circuit. Therefore, general-purpose electrical apparatuses need to be changed in design when they are incorporated in the system. Furthermore, the apparatuses for the system need to be provided with the exclusive circuits, which unavoidably increases the apparatus cost.

On the other hand, a case where an electrical apparatus purchaser does not want to introduce its system and just wants to have an intrinsic function of the electrical apparatus or a case where the purchaser has already introduce a different type of system is also assumed. In this case, the exclusive function of the electrical apparatus for the system is unnecessary for the purchaser, and the electrical apparatus whose price is set high because of its adaptation to the system may not be attractive.

Moreover, in the centralized control system, an installation type computer device or the like is usually used to carry out control. When control conditions/contents are changed, it is necessary to go to a predetermined place where a controlling computer is installed, and perform processing at that place. For example, when the control object or electrical apparatus is a rice cooker, a washing machine, a lighting apparatus, an air conditioner, or another so-called home electrical product, a television set or a videocassette recorder, the control conditions may be changed daily.

Therefore, it is troublesome to go to the controlling computer installation site every time change is required. For the centralized control of various types of electrical apparatuses, control items are limited, and the use of a system cannot be realized.

In the aforementioned security system or the like, when the system is introduced, installation work, wiring work, or another large-scale work is necessary for sensors, communication devices or the like, and installation cost often becomes high. Therefore, system introduction is not considered until a new building needs to be constructed, which causes a problem that it is difficult to popularize the system.

SUMMARY OF THE INVENTION

The present invention has been developed to solve the aforementioned problems, and an object thereof is to provide an centralized apparatus control system in which change of a control object or electrical apparatus is minimized, so that cost is lowered and introduction is facilitated.

Another object of the present invention is to provide a centralized apparatus control system which is low in cost and easy to introduce and which can control not only electrical apparatuses applicable to the system but also electrical apparatuses not-applicable to the system.

A further object of the present invention is to provide a centralized control device optimum for the system, and a terminal device for an apparatus to be controlled.

To attain these objects, the present invention is provided with the following characteristics.

The present invention provides a system for controlling a plurality of electrical apparatuses in a centralized manner comprising a centralized apparatus control device and controlled apparatus terminal devices. The controlled apparatus terminal devices are registered in the centralized apparatus control device, and disposed for the plurality of electrical apparatuses to be controlled, respectively. Radio communication is performed between the centralized apparatus control device and the controlled apparatus terminal device registered in the centralized apparatus control device, so that the corresponding electrical apparatus is controlled via the controlled apparatus terminal device.

As described above, in the present invention, instead of directly performing radio communication between each electrical apparatus and the centralized apparatus control device, the controlled apparatus terminal device is interposed between the electrical apparatus and the centralized apparatus control device, so that the radio communication is performed between the centralized control device and the terminal device. Therefore, the control object or electrical apparatus does not require a radio transmitter/receiver device, and need only be provided with a function by which data can be transmitted/received to and from the controlled apparatus terminal device. Therefore, a structure for the system is simplified, a rise in the manufacturing cost of the electrical apparatus for the system is suppressed, and a difference in cost from an electrical apparatus not-applicable to the system can be minimized.

Moreover, the controlled apparatus terminal device may only exchange data with the electrical apparatus in a predetermined method, and can be mounted on any type of electrical apparatus. A system user can arbitrarily select a necessary electrical apparatus and incorporate it in the system by connecting the separately prepared controlled apparatus terminal device to the apparatus.

Furthermore, the controlled apparatus terminal device can be inexpensive when it is constituted of a function of performing radio communication with the centralized apparatus control device and a function of exchanging predetermined data with the electrical apparatus. Additionally, the radio communication does not need to be performed between various types of electrical apparatuses and the centralized apparatus control device. If a frequency band specifying small electrical power is used in the radio communication, permission needs to be obtained only for the controlled apparatus terminal device and the centralized apparatus control device as indoor radio stations.

Moreover, in the present invention, the controlled apparatus terminal device for use in the system may be provided with a transmitter/receiver for transmitting a state signal of the corresponding electrical apparatus to the centralized apparatus control device and for receiving a control signal from the centralized apparatus control device, and a terminal controller for generating an apparatus control signal in response to the received control signal to transmit the signal to the corresponding electrical apparatus and for detecting the state of the electrical apparatus to generate the state signal.

The terminal device can control any electrical apparatus regardless of its type as long as the electrical apparatus is applicable to the system. Moreover, since the terminal device only requires the function of performing radio communication with the centralized apparatus control device and the function of performing simple data communication with the electrical apparatus, the terminal device can be realized by a simple circuit structure. A small and inexpensive terminal device can easily be obtained. Furthermore, the terminal device can easily be connected to the electrical apparatus by directly plugging a terminal of the terminal device into the electrical apparatus applicable to the system. Specifically, any electrical apparatus can arbitrarily be incorporated into the control system by the centralized control device by connecting the terminal device to the electrical apparatus as long as the apparatus is applicable to the system. Therefore, the user can construct an optional centralized control system at will.

Moreover, the centralized apparatus control system of the present invention is characterized in that individual ID codes attached beforehand to the controlled apparatus terminal devices are registered in the centralized apparatus control device. When the controlled apparatus terminal device is connected to a terminal plug-in section, the centralized apparatus control device reads the individually attached ID code of the controlled apparatus terminal device, and registers the read ID code in an internal memory.

When the ID code is separately attached to the controlled apparatus terminal device and registered in the centralized apparatus control device, malfunctions of the other terminal devices can be easily and firmly prevented by using the ID code in controlling each controlled apparatus terminal device.

Furthermore, according to the present invention, in the controlled apparatus terminal device for use in the aforementioned system, a plurality of terminals are formed on at least one integrated circuit for performing a function of a terminal device, and connected to a plurality of terminals formed on a circuit mounting board by wire bonding. Then, the plurality of terminals of the integrated circuit include a plurality of code setting terminals for setting the individual ID codes. The terminal corresponding to the ID code assigned to the terminal device among the code setting terminals of the integrated circuit is wire-bonded to the code setting terminal set at a predetermined electric potential among the terminals of the circuit mounting board.

When the integrated circuit is mounted on the circuit mounting board to form a device, the terminals of the integrated circuit and the terminals formed on the circuit mounting board are connected by wire bonding. In this wire bonding process, the bonding of the predetermined code setting terminal of the integrated circuit to the code setting terminal of the circuit mounting board can be performed in accordance with each ID code attached to the controlled apparatus terminal device simultaneously with the bonding of the other terminals. For the wire bonding, once the terminal to be connected is set in a control section of a wire bonding device, operation is automatically performed. Therefore, the ID code can be attached to the terminal device without increasing the number of manufacture processes of the terminal device.

Additionally, the method of setting ID codes in the wire-bonding process of the integrated circuit and the circuit mounting board can also be used when individual ID codes are set in an integrated circuit of a general semiconductor device which is connected to a plurality of terminals formed on a circuit mounting board by wire bonding.

The centralized apparatus control system of the present invention is further characterized in that the centralized apparatus control device comprises an internal clock and a timer, the timer measures a set time, and the control signal is transmitted to the controlled apparatus terminal device corresponding to the electrical apparatus to be controlled based on time measurement result. Moreover, the centralized apparatus control device may also comprise a time information receiver for receiving time information broadcasting, so that the time of the internal clock is adjusted based on received time information. When such a time management function is provided, a plurality of electrical apparatuses can be turned on or off uniformly, automatically and selectively based on a correct clock time.

The centralized apparatus control system of the present invention is further characterized in that in response to a predetermined request, the centralized apparatus control device controls the plurality of electrical apparatuses via the controlled apparatus terminal devices to turn on/off the power of the object electrical apparatus.

Here, the "request" includes a request issued based on detection result of a sensor for detecting a predetermined environment change, in addition to a request issued at user's will. For example, it is preferable that if an earthquake occurs, the electrical apparatus is turned off to prevent a fire or another secondary disaster. However, it is difficult to turn off all power supplies of many electrical apparatuses in a short time, and it is sometimes difficult to operate a breaker. Even in this case, according to the system of the present invention, immediately after a user pushes a predetermined batch operation button of the centralized apparatus control device, the object electrical apparatuses can all be turned off via the controlled apparatus terminal devices. Moreover, in this case, for example, when the lighting apparatus is controlled to automatically turn on, confusion at the time of refuge can be relieved. As described above, since the electrical apparatuses are simultaneously controlled to turn on and/or off in response to the request, the centralized control system of the present invention provides a superior function as a disaster prevention system.

Here, the "detection of the predetermined environment change" by the sensor means the detection of an earthquake or another vibration, smoke, flame, human motion or another motion, the detection of shock occurring when windows or doors collapse, or the detection of changes in physical or chemical environment. For example, when the predetermined electrical apparatus is controlled by detecting the vibration, smoke, flame, shock, motion and the like, an operator does not need to operate the centralized apparatus control device. Instead, the power supply of the necessary electrical apparatus can automatically be controlled in response to the environment change. For example, when the electrical apparatus is controlled by detecting the vibration, smoke, flame and the like, the earthquake, fire or other disaster can automatically be coped with. Moreover, when the electrical apparatus is controlled by detecting the shock, motion, and the like, invasion of a building can be detected, or the invasion is effectively prevented, so that a crime prevention function can be provided. Furthermore, when the electrical apparatus is controlled by detecting human motion, electricity is prevented from being wasted due to devices that have not been turned off during the nighttime, or a fire can be prevented from arising because of electricity that has inadvertently been left on.

Another characteristic of the centralized apparatus control system of the present invention lies in that the controlled apparatus terminal device automatically determines whether or not the electrical apparatus is provided with an expanded control function by which a particular item can be controlled by the system, and the content of the item controllable by the function. Results are reported to the centralized apparatus control device as expanded control information. Upon receiving the report, the centralized apparatus control device receives and registers the expanded control information, and controls the control object or electrical apparatus in accordance with the expanded control function via the controlled apparatus terminal device. In the system, the user does not need to individually determine whether or not the electrical apparatus in the system is provided with the expanded control function to perform setting operation. Instead, the centralized apparatus control device can automatically recognize the expanded control function of the control object or electrical apparatus and use that function.

Furthermore, in the present invention, the controlled apparatus terminal device for use in the centralized apparatus control system comprises a single data communication terminal for transmitting/receiving signals to/from the control object or electrical apparatus. The data communication terminal is used to transmit the generated apparatus control signal to the connected electrical apparatus and to detect the state of the electrical apparatus and the presence of the expanded control function as the function to be controlled by the system for the particular item. Since the communication between the controlled apparatus terminal device and the electrical apparatus is performed by the single data communication terminal, the circuit structure of the terminal device and the structure of the electrical apparatus applicable to the system can easily be simplified.

In another aspect of the present invention, a system for controlling a plurality of electrical apparatuses in a centralized manner comprises a centralized apparatus control device for controlling a control object or electrical apparatus using a radio communication function, a controlled apparatus terminal device registered in the centralized apparatus control device for transmitting a predetermined apparatus control signal to the control object or electrical apparatus based on radio communication with the centralized apparatus control device, and an apparatus power supply control device interposed between the controlled apparatus terminal device and the control object or electrical apparatus for receiving the apparatus control signal from the controlled apparatus terminal device to control operation power supply to the control object or electrical apparatus.

In another aspect of the present invention, an apparatus power supply control device is used in a system for controlling a plurality of electrical apparatuses via controlled apparatus terminal devices using a centralized apparatus control device in a centralized manner, and interposed between a control object or electrical apparatus and the controlled apparatus terminal device registered in the centralized apparatus control device for outputting a predetermined apparatus control signal to control the control object or electrical apparatus based on radio communication with the centralized apparatus control device. The apparatus power supply control device receives the apparatus control signal from the controlled apparatus terminal device to control operation power supply to the control object or electrical apparatus.

In the system, radio communication is performed only between the centralized apparatus control device and the controlled apparatus terminal device registered in the device, and the apparatus power supply control device is interposed between the controlled apparatus terminal device and the electrical apparatus. Therefore, even when the control object or electrical apparatus is not applicable to the system, the operation of the electrical apparatus can be substantially controlled by the centralized apparatus control device by controlling the operation power supply to the electrical apparatus non-applicable to the system by the apparatus power supply control device in response to a control order from the controlled apparatus terminal device.

Moreover, in another aspect of the present invention, the apparatus power supply control device comprises a switch section for switching conducting and non-conducting of a power supply path between a predetermined operation power supply and the control object or electrical apparatus, a switch controller for controlling the switch section, and a detector for detecting a conducting or non-conducting state of the power supply path. In response to the apparatus control signal from the corresponding controlled apparatus terminal device, the switch controller controls the switch section to control the conducting or non-conducting of the power supply path, and the conducting or non-conducting state of the power supply path detected by the detector is reported to the corresponding controlled apparatus terminal device.

As described above, when the apparatus power supply control device not only controls the conducting or non-conducting of the power supply path between the operation power supply and the electrical apparatus but also detects the conducting or non-conducting state, the operation state of the control object or electrical apparatus can be reliably detected. The non-conducting state of the power supply path indicates that the switch section controls the supply path so as not to conduct electricity, or that the power supply path between the operation power supply and the electrical apparatus is cut by turning off a power switch of an electrical apparatus unit. The conducting state of the power supply path indicates that the switch section controls the supply path to conduct electricity or that the power supply path between the operation power supply and the electrical apparatus is controlled to conduct electricity by turning on the switch of the electrical apparatus unit. Therefore, when the conducting or non-conducting state of the power supply path is detected and reported to the centralized apparatus control device via the controlled apparatus terminal device, the centralized apparatus control device recognizes the on/off state of the power supply of the electrical apparatus, i.e., the on/off state of operation, so that the state of the electrical apparatus can be controlled.

Moreover, in another aspect of the present invention, a system for controlling a plurality of electrical apparatuses in a centralized manner comprises a centralized apparatus control device for controlling a control object or electrical apparatus using a radio communication function, a controlled apparatus terminal device registered in the centralized apparatus control device for transmitting a predetermined apparatus control signal to the control object or electrical apparatus based on radio communication with the centralized apparatus control device, and an apparatus power supply control device interposed between the controlled apparatus terminal device and the control object or electrical apparatus for receiving the apparatus control signal from the controlled apparatus terminal device to control operation power supply to the control object or electrical apparatus. The controlled apparatus terminal device is connected to the electrical apparatus applicable to the system, and the centralized apparatus control device controls the electrical apparatus applicable to the system via the controlled apparatus terminal device connected to the apparatus. The apparatus power supply control device is connected to an electrical apparatus non-applicable to the system, the controlled apparatus terminal device is connected to the apparatus power supply control device, and the centralized apparatus control device controls the electrical apparatus non-applicable to the system via the apparatus power supply control device connected to the apparatus and the controlled apparatus terminal device connected to the apparatus power supply control device.

When the electrical apparatus applicable to the system is connected to the controlled apparatus terminal device, it can be controlled by the controlled apparatus terminal device. Moreover, when the controlled apparatus terminal device is connected to the apparatus power supply control device in the same manner as another electrical apparatus applicable to the system, the apparatus power supply control device can be controlled by the controlled apparatus terminal device. Therefore, either the electrical apparatus applicable to the system or the electrical apparatus non-applicable to the system can be arbitrarily incorporated into the control system by the centralized control device by connecting the controlled apparatus terminal device to the apparatus directly or indirectly via the apparatus power supply control device. Consequently, the user can construct an optional centralized control system at will.

DESCRIPTION OF THE PREFERRED EMBODIMENT

A preferred embodiment of the present invention (hereinafter referred to as the embodiment) will be described hereinafter with reference to the drawings.

[Structure of System]

Figure 1:
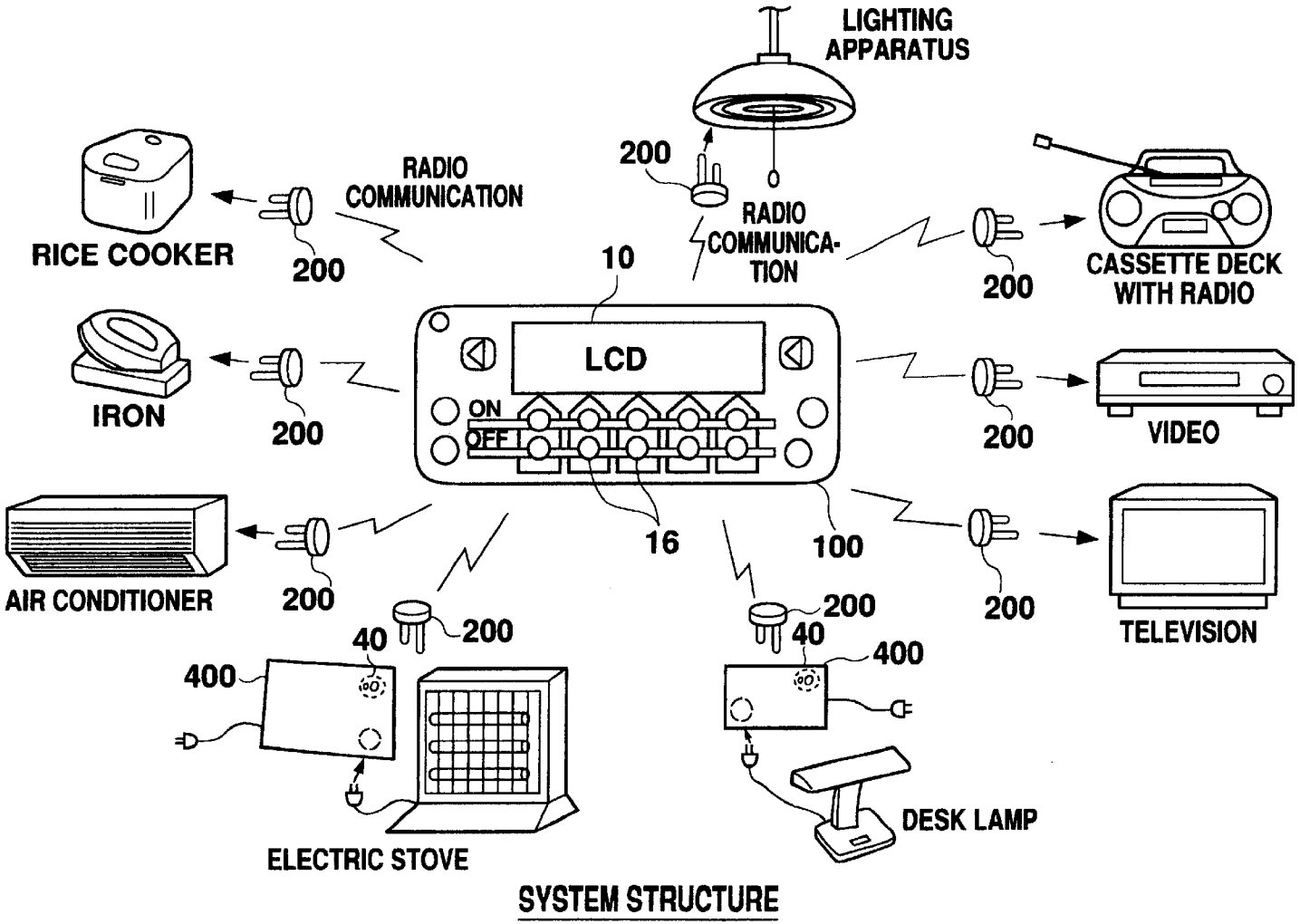
FIG. 1 is a schematic view showing a structure of an electrical centralized apparatus control system of the embodiment.

FIG. 1 schematically shows a structure of a centralized apparatus control system of the embodiment of the present invention. In the centralized control system, a centralized apparatus control device (hereinafter referred to as the host unit) 100 is provided with a function of host computer for controlling electrical apparatuses in a centralized manner. The apparatuses to be controlled by the host unit 100 include an electric rice cooker, an iron and other home electrical products, a television set, a videocassette recorder, a cassette deck with radio, a lighting apparatus and various electrical apparatuses used daily in houses or offices. Moreover, in the system, the power supply of the electrical apparatus is not limited to electricity. For example, an oil fan stove or another device which is operated by power other than electric power but is electrically controlled can be controlled in a centralized manner.

In the system, separately from each control object or electrical apparatus, a small-size controlled apparatus terminal device (hereinafter referred to as the terminal unit) 200 is interposed between the corresponding electrical apparatus and the host unit 100, and radio communication is performed between the terminal unit 200 and host unit 100 for the centralized control of the apparatus. Each electrical apparatus is provided with a receptacle (terminal plug-in section) to which the terminal unit 200 can be connected. When the terminal unit 200 is plugged into the receptacle, the host unit 100 controls a power supply of the electrical apparatus or another function via the plugged terminal unit 200.

For the communication between terminal unit 200 and host unit 100, both units are used as indoor radio stations, and digital radio communication is performed using a band, for example, of 230 to 240 MHz or around 400 MHz (specified small electric power). For a narrower range control, radio communication by very weak radio stations, infrared communication, or the like may be performed. In the radio communication, even when the present system is introduced, the electrical apparatus can be controlled by the host unit 100 and the terminal unit 200. Therefore, no wiring work or the like needs to be performed indoors. Furthermore, the radio communication is constantly performed only between terminal unit 200 and host unit 100 regardless of the type of electrical apparatus to be controlled. Therefore, the radio system is constituted by the terminal unit 200 and the host unit 100.

Identification codes, for example, each of 32 bits (hereinafter referred to as the ID code) are individually assigned to the terminal units 200 at the time of manufacture as described later, and the host unit 100 identifies and controls each terminal unit 200 by its ID code. ID code of the terminal unit 200 can be registered in the host unit 100. After registration, when the terminal unit 200 is plugged into the optional electrical apparatus which is to be incorporated in the centralized control system, the selectively corresponding electrical apparatus is controlled by the host unit 100 via the terminal unit 200. Additionally, for the radio communication between the host unit 100 and terminal unit 200, in order to prevent the malfunction of other electrical apparatuses, spread spectrum communication or the like is preferably performed.

When the terminal unit 200 whose ID code is registered in the host unit 100 is connected to the electrical apparatus, it can constantly receive signals transmitted from the host unit 100. Subsequently, upon receiving a control signal with the ID code attached thereto from the host unit 100, the terminal unit 200 recognizes the control signal transmitted to itself, controls the corresponding electrical apparatus, and transmits a signal to the host unit 100 reporting that control is completed. If the host unit 100 transmits the control signal to the specific terminal unit 200 with no reply from the terminal unit, transmission is performed several times. When the host unit retries but still receives no response from the terminal unit, the electrical apparatus corresponding to the ID code displays an alarm message on a display panel 10 of the host unit 100 indicating that no response is received or that transmission does not work.

Moreover, automatically or in response to a request from the host unit 100, the terminal unit 200 reports the state of the electrical apparatus (e.g., whether power supply is turned on or off) to host unit 100. The host unit 100 stores the obtained state of each apparatus, and displays the stored state when a system user selects the apparatus. For example, when "lighting of a children's room" is selected in the host unit 100, and it has been reported that "lighting is turned on", it is indicated on the display that the "lighting is turned on". Moreover, when a "living room air conditioner" is selected and it has been reported that power supply is turned off, it is indicated that the "air conditioner is turned off". Furthermore, when a door lock sensor is used as the electrical apparatus, or a sensor provided with a terminal function is used, and "door lock" is selected in the host unit 100, for example, it is indicated on the display that a "kitchen door is open". Therefore, the system user can know the state of the control object or electrical apparatus from the display panel 10 of the host unit 100. Furthermore, an appropriate order can be issued even to the apparatus installed in a different place using the host unit 100.

Figure 2:
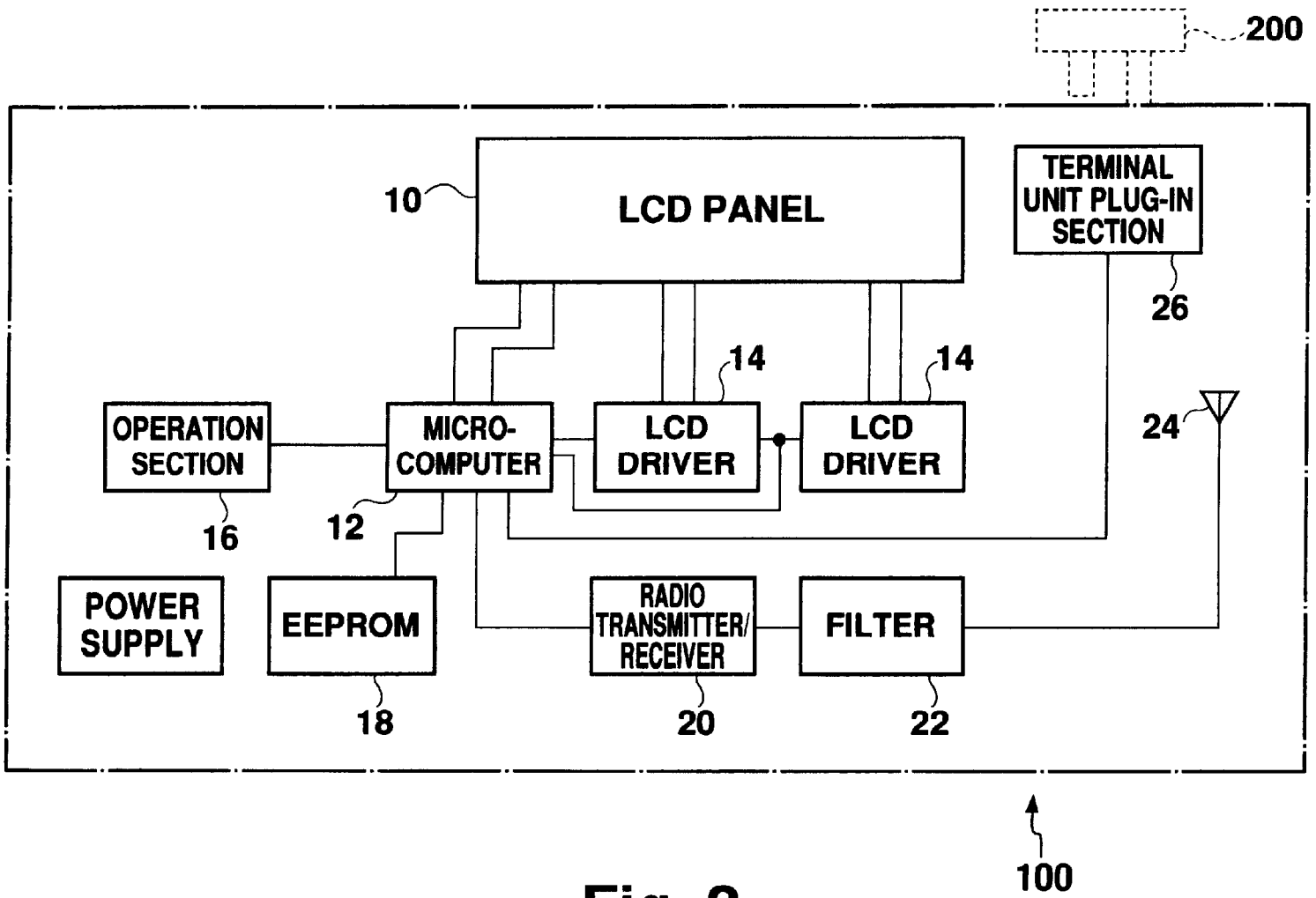
FIG. 2 is a block diagram showing a circuit structure of a host unit 100 of the embodiment.
Figure 3:
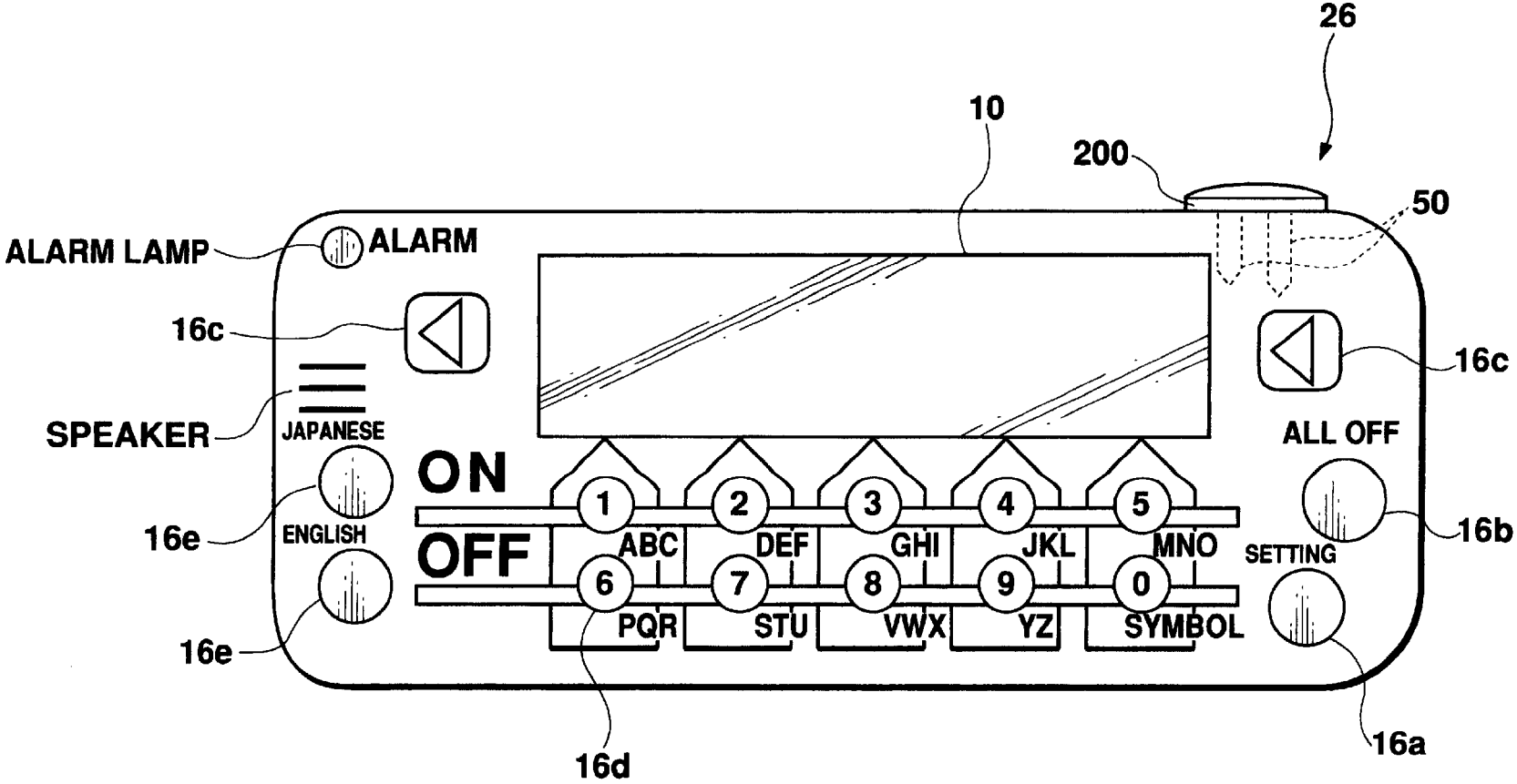
FIG. 3 is a schematic view showing a structure of the host unit 100 of the embodiment.

FIG. 2 schematically shows a circuit of the host unit 100, and FIG. 3 shows a device structure. The host unit 100 comprises an LCD display panel 10, an operation section 16, a microcomputer 12, an internal power supply or battery, a communication section, an LCD driver(s) 14, EEPROM 18, a terminal unit plug-in section 26, and the like, and has a portable, relatively small structure.

Displayed on the display panel 10 is the content of control setting, the operational state of the electrical apparatus constantly or periodically transmitted from the terminal unit 200 (e.g., power supply on, off), or the like. The operation section 16 is disposed on a housing surface of the device, and comprises operation buttons by which various conditions can be entered or set. Additionally, a touch panel type display panel 10 may be used. In this case, a part of the operation section may be used as the display panel 10. For example, as shown in FIG. 3, the operation section 16 is provided with a setting button 16*a* for shifting a mode of setting terminal unit registration deletion, time setting/display, voice output or the like, an all-off button 16*b* for turning off power supply to all controlled electrical apparatuses, scroll buttons 16*c* for selecting a plurality of items, character input buttons 16*d* for inputting characters, input mode buttons 16*e* for selecting an input character type (Japanese, English characters), and various necessary buttons.

The communication section of the host unit 100 is provided with a transmitter/receiver 20 for performing transmission/reception in radio communication with the terminal unit 200, a filter circuit 22 and an antenna 24. LCD drivers 14 are provided for operating the LCD display panel 10 in which matrix type or partially segment electrodes are used. EEPROM 18 is a memory for storing the ID code of each terminal unit 200, the setting content for centralized control, and the like, in which the ID code of each terminal unit 200 is read and registered. The microcomputer 12 is a centralized controller for controlling the radio transmitter/receiver 20, LCD driver 14, the operation section 16, EEPROM 18, the terminal unit plug-in section 26, and the like and for controlling each terminal unit 200 by the radio communication via the antenna 24.

Figure 4:
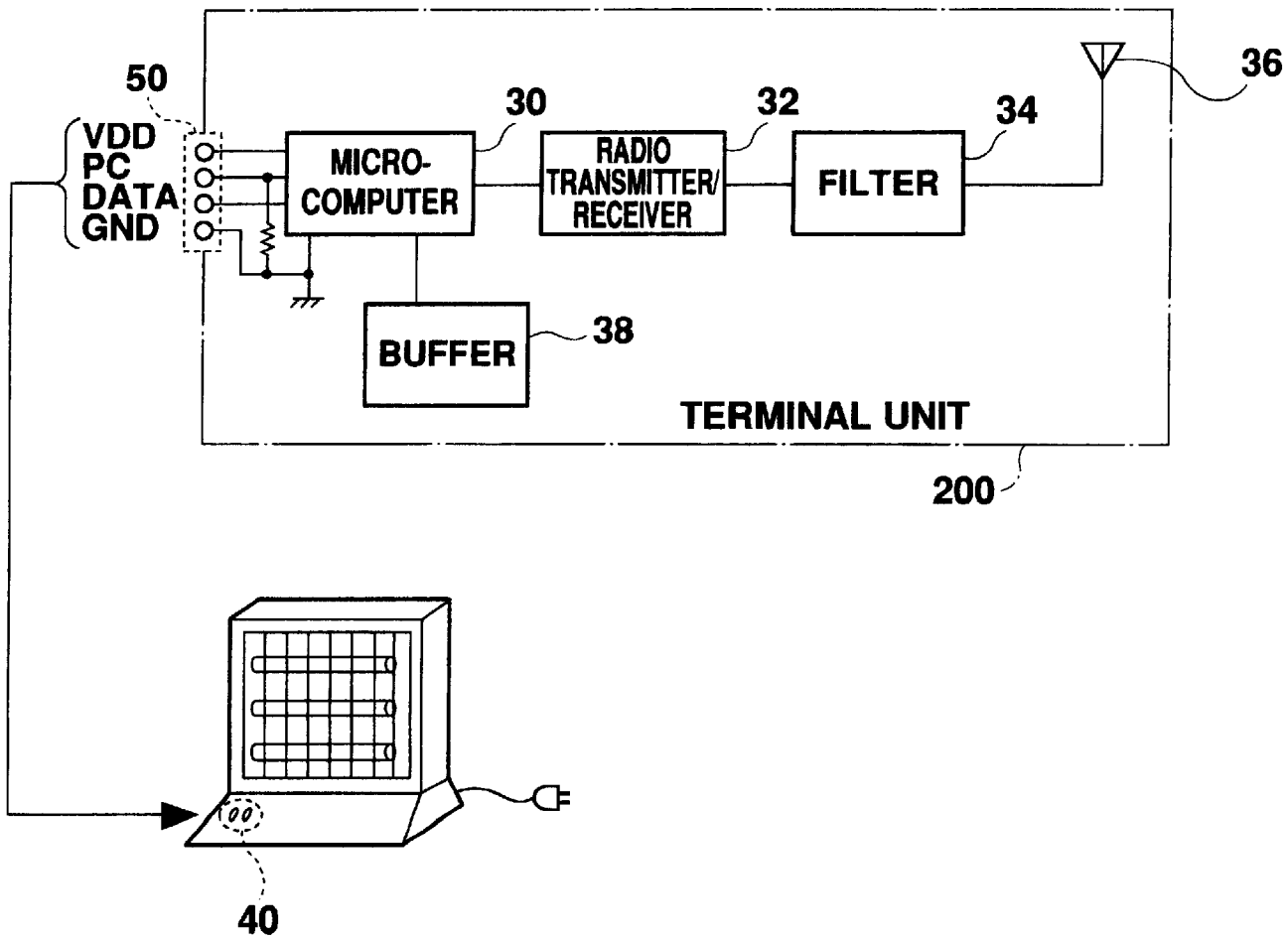
FIG. 4 is a block diagram showing a structure of a terminal unit 200 of the embodiment.
Figure 5:
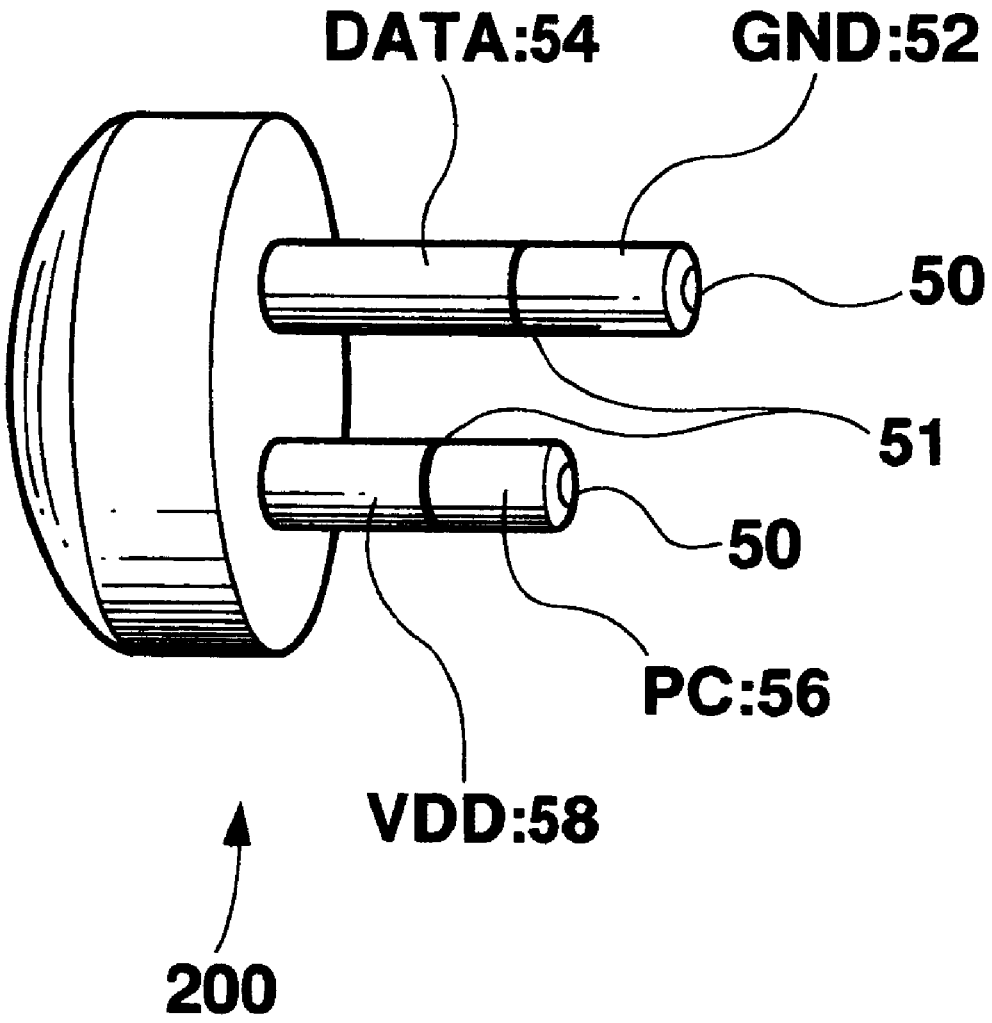
FIG. 5 is a view showing the structure of the terminal unit 200.

A structure of the terminal unit 200 will next be described. FIGS. 4 and 5 schematically show the structure of the terminal unit 200. The terminal unit 200 comprises a radio transmitter/receiver 32, a filter 34 and a built-in antenna 36, as a transmission section for performing radio communication with the host unit 100. The terminal unit 200 also comprises a microcomputer 30, which controls the entire operation of the terminal unit 200, generates a signal for controlling the connected electrical apparatus, and detects the state of the electrical apparatus to generate a signal for reporting the state to the host unit 100. The terminal unit 200 further comprises a buffer 38 for temporarily storing transmitted/received data.

A terminal 50 of the terminal unit 200 comprises two plug-in terminals, which can be plugged into a terminal plug-in section 40 provided on the electrical apparatus. Each of the plug-in terminals is electrically separated further into two terminals by an insulation separating section 51, and the terminal 50 is formed of four-pole terminals. When the terminal unit 200 has no internal power supply, four-pole terminals are provided: GND terminal 52; DATA terminal 54; PC (power control) terminal 56; and VDD terminal 58. When the terminal unit 200 has the internal power supply, VDD terminal 58 is replaced with CS (connect sense) terminal for detecting connection to the electrical apparatus.

The terminal plug-in section 40 provided on the electrical apparatus comprises four-pole terminals: VDDS (VDD supply) terminal; PC terminal; DATA terminal and GND terminal, corresponding to the terminal 50 of the terminal unit 200. When the terminal unit 200 is plugged into the terminal plug-in section 40 of the electrical apparatus, and no power supply is built into the terminal unit 200, electric power is first supplied from the electrical apparatus via VDD terminal 58 to activate the terminal unit 200. Thereafter, the terminal unit 200 performs non-synchronous serial communication with the electrical apparatus via the DATA terminal 54 and DATA terminal of the electrical apparatus to detect the power supply state of the electrical apparatus or the like. As a result, the terminal unit 200 reports its ID code and the power supply on/off state of the detected apparatus spontaneously or in response to a request for circumstance report from the host unit 100. Moreover, upon receiving the control signal from the host unit 100, the terminal unit 200 transmits to the electrical apparatus the apparatus control signal corresponding to the control signal via DATA terminal 54 or PC terminal 56 to control the turning on/off of the power supply. Additionally, the control signal transmitted from the host unit 100 may be transmitted to the terminal unit 200 as the apparatus control signal as it is.

Additionally, when the electrical apparatus is provided with an expanded function by which a particular item can be further controlled by the centralized control system as described later, the terminal unit 200 detects via its DATA terminal 54 whether or not the apparatus is provided with the expanded function.

If the electrical apparatus is applicable to the aforementioned system, it can be controlled by the host unit 100 by plugging the terminal unit 200 into the electrical apparatus. However, there is a case where the electrical apparatus is not applicable to the system. It is an economic burden for the user to replace all the electrical apparatuses non-applicable to the system with the electrical apparatuses applicable to the system.

In the present system, even when the electrical apparatus is non-applicable to the system, the power supply of the electrical apparatus can be controlled. The control of the electrical apparatus non-applicable to the system is realized by interposing a power supply control unit for controlling operation power supply to the electrical apparatus between the electrical apparatus and the terminal unit 200.

In the example of the system structure shown in FIG. 1, the desk lamp and the electric stove are non-applicable to the system. A power supply plug of the electrical apparatus non-applicable to the system (the desk lamp and the electric stove in FIG. 1) can be plugged into a power supply control unit 400, which also comprises a terminal plug-in section 40 to which the terminal unit 200 can be connected. The power supply control unit 400 is controlled by radio communication performed between the connected terminal unit 200 and the host unit 100 in the same manner as the other electrical apparatuses applicable to the system. Specifically, the power supply control unit 400 controls the operation power supply or commercial power supply to the non-applicable electrical apparatus with the power supply plugged therein, based on the control signal transmitted from the host unit 100 via the terminal unit 200. Furthermore, the power supply control unit 400 reports to the host unit 100 via the terminal unit 200 whether or not the commercial power is supplied to the electrical apparatus. Additionally, the structure, power supply control operation, and the like of the power supply control unit 400 will be described later.

Even if there are some apparatuses non-applicable to the system in a plurality of electrical apparatuses to be controlled in a centralized manner, the power supply control unit 400 can be connected to the non-applicable apparatus. In this case, the host unit 100 may control the terminal unit 200 of the same type as that for the electrical apparatus applicable to the system. Thereby, the power supply of the electrical apparatus non-applicable to the system can indirectly be controlled via the power supply control unit 400.

Additionally, the terminal unit 200 attached to the power supply control unit 400 is the same in structure as the terminal unit 200 attached to the electrical apparatus applicable to the system. Moreover, the terminal unit 200 attached to the electrical apparatus applicable to the system and the terminal unit 200 attached to the power supply control unit 400 are the same in communication method with the terminal unit 200 and the host unit 100 and ID registration method described later.

[Identification, Registration of Terminal Unit]

Figure 6B:
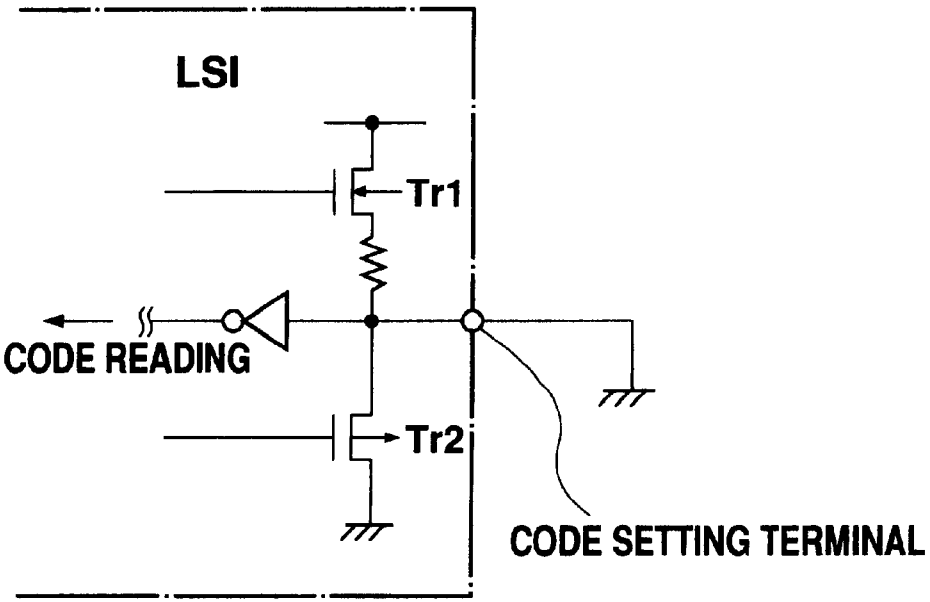
FIGS. 6A and 6B are explanatory views showing a method of setting an ID code of the terminal unit 200.
Figure 6A:
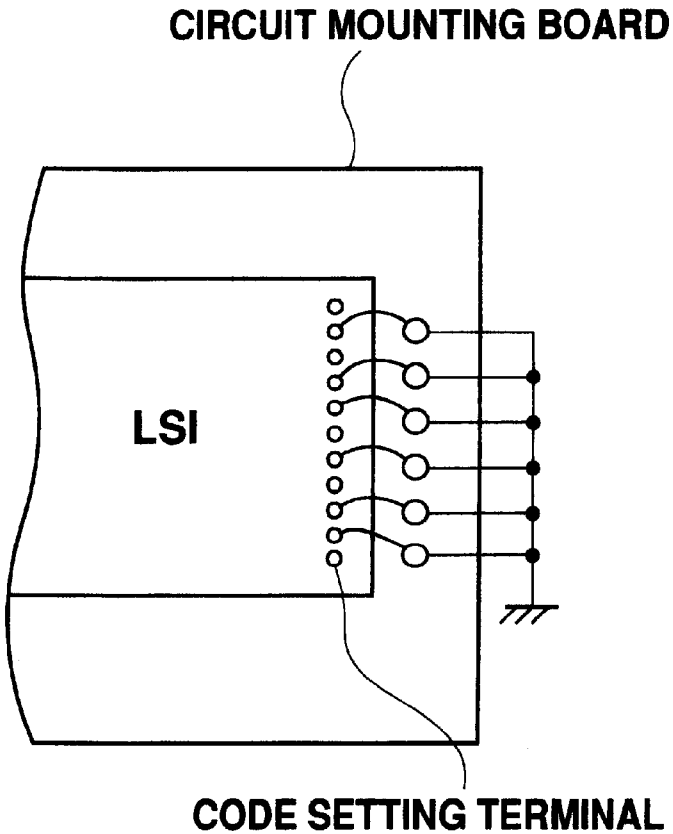

FIGS. 6A and 6B show a method of assigning individual ID codes to the terminal units 200. When the terminal unit 200 having the circuit structure shown in FIG. 4 is constituted as one integrated circuit (LSI) by integrating some or all of the function circuits (microcomputer 30, buffer 38, communication section) in the same substrate, the LSI, necessary elements, and the like are mounted on a circuit mounting board. In this case, after the LSI is mounted on the circuit mounting board, terminals formed on the LSI are connected to the corresponding terminals of the circuit mounting board by wire bonding.

In the present system, the wire bonding process is used to assign an ID code to an LSI for each terminal unit. Specifically, as shown in FIG. 6A, when the terminal unit LSI is connected to the circuit mounting board, for a plurality of code setting terminals, only code setting terminals corresponding to ID code assigned to the terminal unit 200 are bonded, and the remaining code setting terminals are opened (non-connected). After the necessary LSI terminals are connected to the circuit mounting board through this process, each terminal unit LSI accesses its code setting terminals to read the set ID code, and uses the read code as the ID code assigned thereto.

For example, as shown in FIG. 6B, a p-type transistor Tr1 and a pull-up resistor are connected between each of the code setting terminals and the power supply, and a n-type transistor Tr2 is connected between the code setting terminal and ground. Moreover, the wire-bonded terminals are all connected to GND on the circuit mounting board.

At the time of reading the ID code, when the transistor Tr1 is controlled to turn on, "1" is read from the non wire-bonded terminals, and "0" is read from the wire-bonded terminals. Additionally, since the transistor Tr2 is unnecessary in reading the code from the code setting terminals, it can be omitted. However, in order to prevent the electrical potential of the terminal, particularly of the non wire-bonded terminal, from becoming unstable, as shown in FIG. 6B, the transistor Tr2 is connected between the code setting terminal and ground, and preferably controlled to turn on in cases other than where the code is read.

Additionally, the circuit structure for reading the set ID code from the code setting terminals is not limited to the circuit structure shown in FIG. 6B, and may be any other structure as long as it can be detected whether or not the terminals are wire-bonded.

The ID code setting method is not limited to the method of attaching ID code to the terminal unit 200 by wire-bonding only the LSI terminals corresponding to the code, and the conventional method of setting a single code in an IC can be used. For example, ID code information may be stored in advance using EEPROM or the like, or an ID code may be set by turning on or off a switch provided on the circuit mounting board. Alternatively, after the wire-bonding process, among the terminals of the circuit mounting board connected to LSI terminals, only the terminals corresponding to the ID code may further be connected via jumpers.

However, for example, when EEPROM or the like is used or the switch is provided, the number of circuit elements is increased. Moreover, in the method of using the jumpers for connection, the process of connecting the jumpers is separately necessary after the wire-bonding process, which results in an increase in manufacture cost. On the other hand, when the setting of the ID code as well as the connection of other terminals are performed at the time of wire bonding as described above, the ID code can be set automatically without increasing the number of processes by setting a desired program in the wire bonding device. This prevents the manufacturing cost of the terminal unit 200 from increasing because of the attachment of the ID code.

A method of registering the ID code set in each terminal unit 200 into the host unit 100 will next be described. The registration of ID code to the host unit 100 is performed by directly inserting the terminals 50 of the terminal unit 200 into the terminal unit plug-in section 26 provided on the host unit 100 as shown in FIG. 3.

Figure 8A:
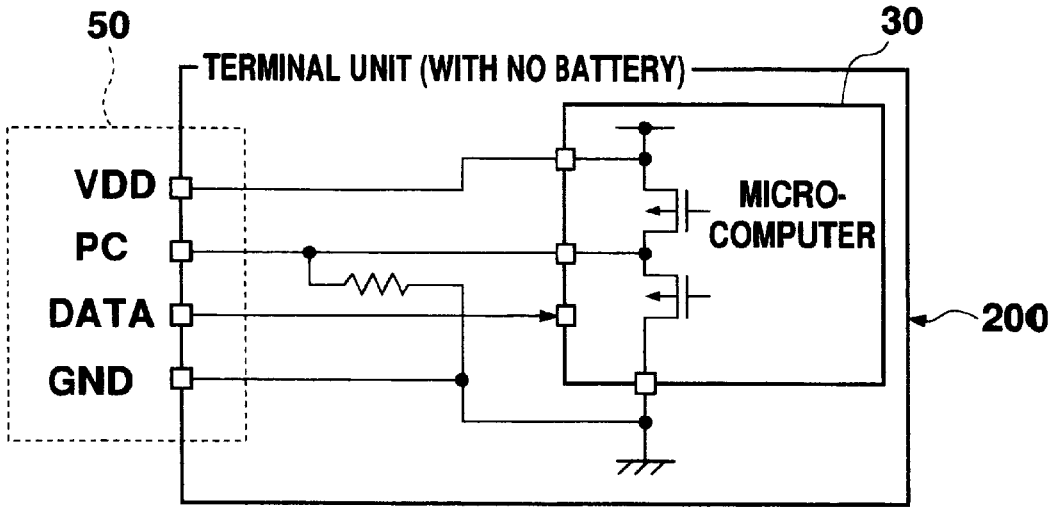
FIGS. 8A and 8B are circuit diagrams showing a terminal 50 of the terminal unit 200 and its interface section.
Figure 8B:
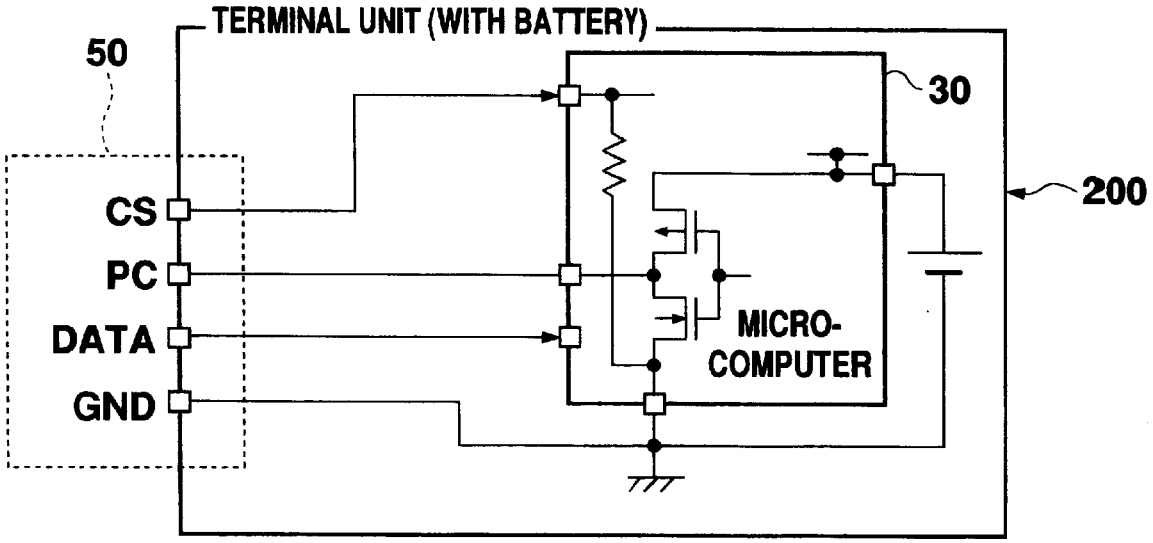

The terminal unit 200 is provided with the communication section and the microcomputer 30, and also with the terminals 50 for performing data communication directly with the electrical apparatus and the host unit 100 as shown in FIGS. 8A, 8B. As described above, the terminal 50 comprises four-pole terminals VDD(CS), PC, DATA and GND. Although VDD terminal and CS terminal are replaced with each other depending on whether or not the terminal unit 200 has an internal power supply (battery), the structure basically remains the same.

When the terminal unit 200 is connected to the electrical apparatus applicable to the system, PC terminal is used to keep constant a voltage level inside the terminal unit 200. On the other hand, when the terminal unit 200 is connected to the power supply control unit 400 for controlling the electrical apparatus non-applicable to the system, a switch section 80 disposed in a power supply path of the power supply control unit 400 needs to be controlled (refer to FIGS. 19, 20). In this case, a control signal is transmitted to the switch section 80 from the PC terminal having a higher current supply ability than the DATA terminal, and the DATA terminal is used for detecting whether or not the power supply path conducts electricity. Additionally, the control signal may be transmitted from the DATA terminal of the terminal unit 200 in the same manner as when the terminal unit is connected to the electrical apparatus applicable to the system.

Figure 7:
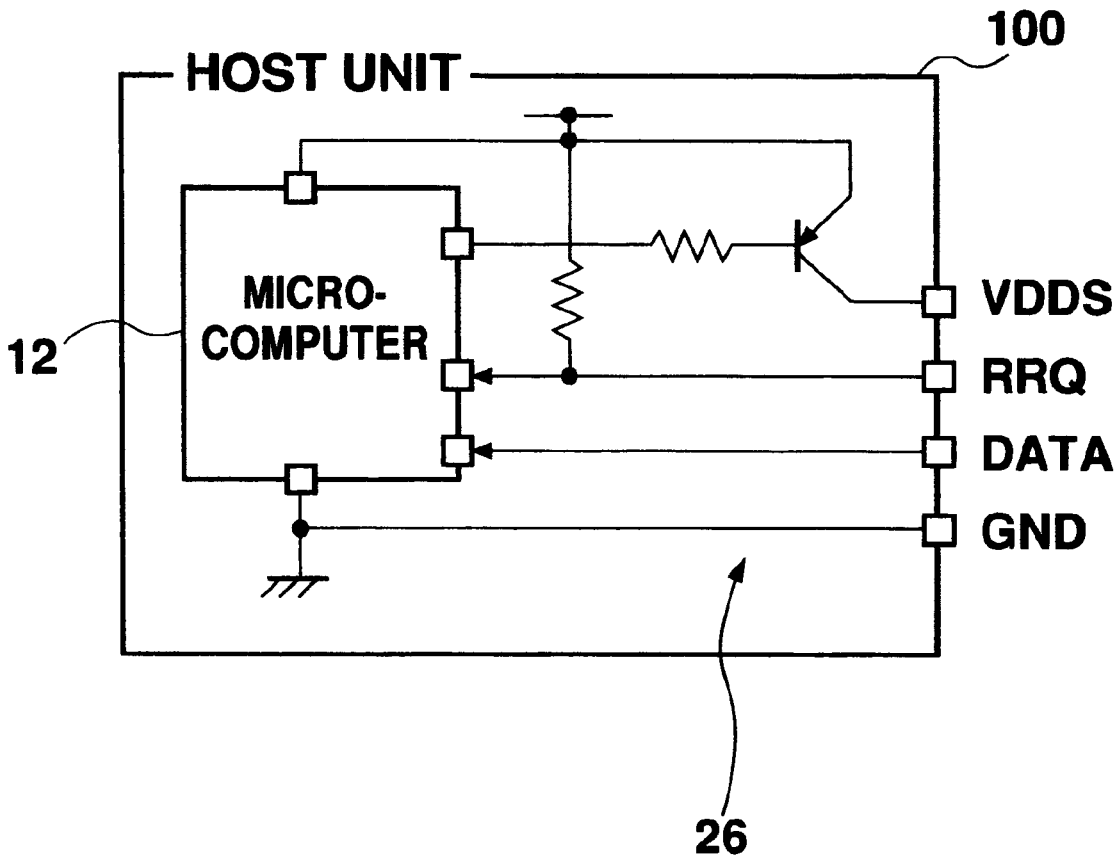
FIG. 7 is a circuit diagram showing a terminal unit plug-in section 26 of the host unit 100.

As shown in FIG. 7, the plug-in section 26 of the host unit 100 is provided with an interface circuit and four terminals VDDS, RRQ, DATA and GND corresponding to the four-pole terminals of the terminal unit 200. When the terminal unit 200 is provided with no internal power supply, the VDDS (VDD supply) terminal of the host unit 100 supplies power VDD to the terminal unit 200 via a transistor, and the GND terminal is set to a reference potential GND of the host unit to establish correspondence to the reference potential of the connected terminal unit 200. Moreover, the RRQ (registration request) terminal determines whether the terminal unit 200 is connected to the host unit 100. When the terminal unit 200 is connected, the DATA terminal of the host unit 100 performs non-synchronous bi-directional serial communication with the DATA terminal for ID code registration.

The procedure for registering the terminal unit 200 (ID code) to the host unit 100 will be described hereinafter with reference to FIG. 9. First, the terminal unit 200 to be registered is connected to the host unit 100 as shown in FIG. 3 (S21). The microcomputer 12 of the host unit 100 judges via RRQ terminal shown in FIG. 7 whether the terminal unit 200 is connected (S1) and, when recognizing the connection, reports the recognition of the terminal to the terminal unit 200 via mutual DATA terminals by non-synchronous serial communication (S2). Moreover, the microcomputer transmits to the terminal unit 200 a request for the start of ID code registration (S3).

When the terminal unit 200 is provided with no internal power supply (battery), the system is activated upon being supplied with electric power from the host unit 100. Thereafter, the microcomputer 30 of the terminal unit 200 judges, in response to a signal indicating the recognition of the terminal from the host unit 100, whether the host unit 100 recognizes itself (terminal side) (S22). When it is judged that the host unit 100 recognizes itself (yes in S22), the terminal unit 200 further judges whether the request for the start of ID code registration is transmitted from the host unit 100 (S23). When there is a request for the registration start (yes in S23), the terminal unit 200 transmits the ID code read via its ID code setting terminals to the host unit 100 via its DATA terminal (S24).

Upon receiving the ID code from the terminal unit 200 (yes in S4), the host unit 100 registers the received ID code to EEPROM 18 in the unit 100 (S5). When the registration is completed, the host unit 100 reports to the terminal unit 200 that the registration is completed (S6), and further sends back the registered ID code.

The terminal unit 200 judges whether the registration completion is reported from the host unit 100 (S25), receives the report (yes in S25), and judges whether the returned ID code coincides with its ID code (S26). When both ID codes coincide with each other (yes in S26), the terminal unit 200 reports the successful terminal registration to the host unit 100 (S27). On the other hand, when two ID codes do not coincide with each other (no in S26), terminal registration failure is reported (S28).

The host unit 100 judges whether the terminal registration has succeeded based on the report of successful or failed terminal registration from the terminal unit 200 (S8) and, in the case of success (yes in S8), displays a registration success message on the display panel (S9). Moreover, in the case of failure (no in S8), a registration failure message is displayed on the display panel (S10).

In the aforementioned procedure, the ID code of the terminal unit 200 can be automatically registered just by connecting the terminal unit 200 to be registered to the host unit 100. After the registration is completed, the registered terminal unit 200 is connected to the electrical apparatus to be controlled. When radio communication is performed between host unit 100 and terminal unit 200 using the ID code, the specified terminal unit 200 can be arbitrarily and correctly selected from the registered terminal units 200, so that the corresponding electrical apparatus (electrical apparatus applicable to the system) can be controlled. Moreover, the electrical apparatus non-applicable to the system can be controlled via the power supply control unit 400. Additionally, for example, when the ID code is set in 32 bits, there is a remarkably low possibility of coincidence of ID codes among the terminal units 200, so that the terminal unit 200 can be identified securely.

When the terminal unit 200 is connected to the host unit 100 in such a manner that its ID code can automatically be registered, the system user does not have to perform an intricate operation of checking the ID code attached to the terminal unit 200 and registering the code in the host unit 100, so that incorrect registration can further be securely prevented. Additionally, it is unnecessary to have the terminal unit 200 constantly connected directly to the host unit 100 for the registration of ID code of the terminal unit 200. Even when radio communication is performed based on the request from the host unit 100, the ID code of the terminal unit 200 can be registered in substantially the same manner as shown in FIG. 9.

For the setting of the type, control item, and the like of the electrical apparatus connected to the registered terminal unit 200 or the setting of the type and the like of the electrical apparatus connected via the power supply control unit 400, for example, after the ID code is registered to the host unit, the setting button 16*a* of FIG. 3 is pushed to shift to a desired setting mode, so that setting is performed while a menu is indicated on the display panel. Alternatively, after the ID code is registered and the terminal unit 200 is connected to the electrical apparatus, the setting button 16*a* of the host unit 100 may be operated for the setting. Additionally, when there are a larger number of types and control items of the registered terminal units 200 or the electrical apparatuses that can be registered than those which can be indicated in one screen of the display panel 10, they are indicated for selection on the display panel 10 using the scroll buttons 16*c* provided on the host unit 100.

Figure 9:
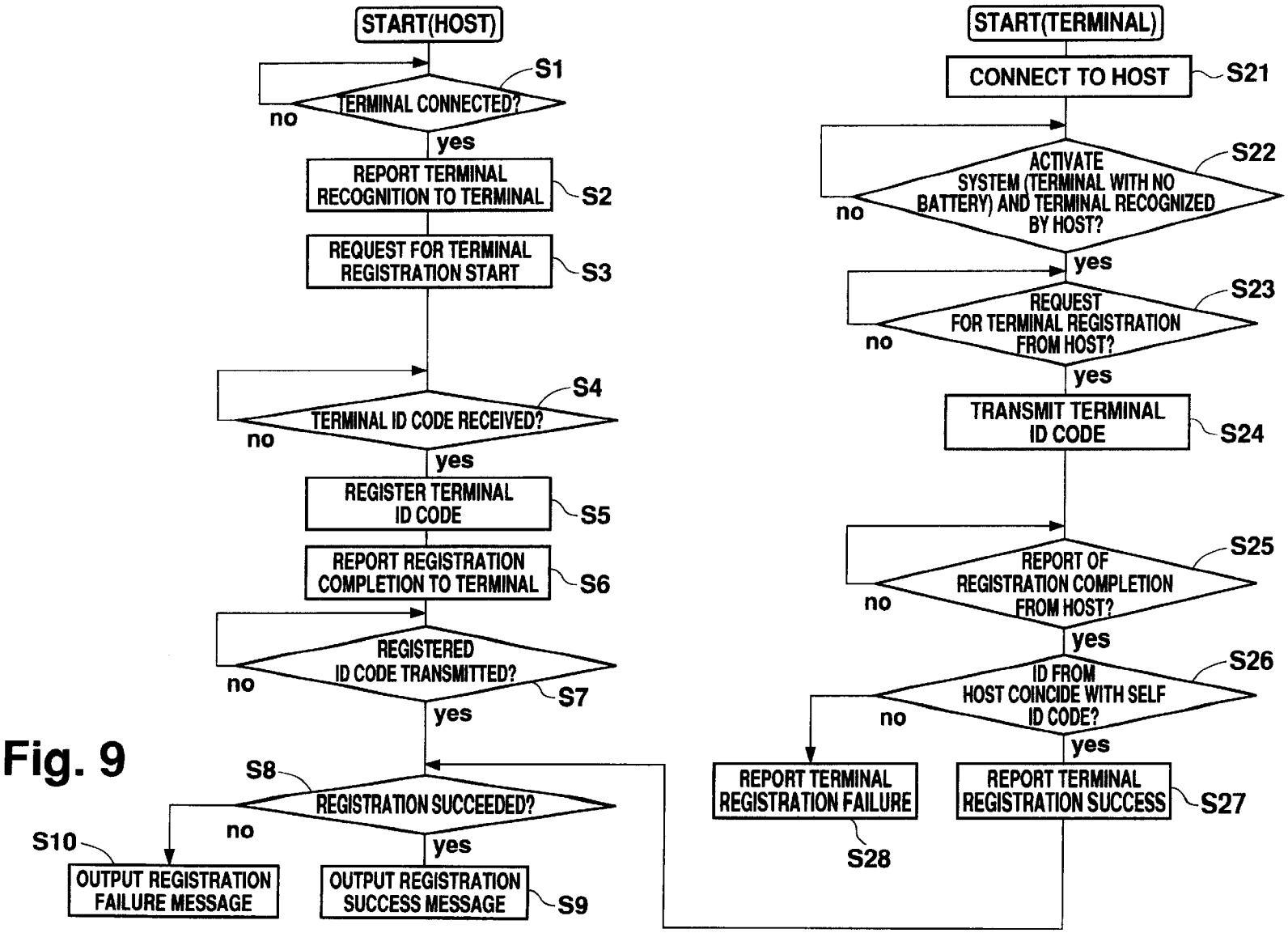
FIG. 9 is a flowchart showing procedure for registering an ID code of the terminal unit 200 into the host unit 100.

Additionally, when it is judged in the step S8 that the registration of the terminal unit has failed, the registration procedure shown in FIG. 9 is repeated until the registration succeeds, or the procedure is repeated a predetermined number of times. Moreover, since the registration failure is considered to be caused by defective connection or failure of the terminal unit, in the case of registration failure, the ID code registration procedure of the terminal unit 200 may be forced to complete without retrying. In this case, the operator reconnects the terminal unit 200 to the host unit 100, or discards the terminal unit 200 and registers and uses a new terminal unit 200. Here, in the present system, an inexpensive terminal unit 200 is realized by simplifying the structure of the terminal unit 200 as much as possible. Therefore, even when the terminal unit 200 is discarded in the case of registration failure, the economic burden of the system user can be minimized.

[Time Management]

A centralized time management mechanism in the centralized control system of the embodiment will be described. At present, many electrical apparatuses contain clock functions and timer functions, and the functions are activated based on their own clocks. However, at the time of purchasing a new apparatus or after service interruption, time needs to be set on the apparatuses in different ways. Moreover, since time error differs with the apparatuses, adjustment operation is troublesome.

In the present system, for example, when the microcomputer 12 of the host unit 100 is provided with the clock and timer functions, each terminal unit 200 can be controlled based on the clock and timer functions of the host unit 100. Additionally, in the host unit 100 the time is set, for example, by pushing the setting button 16*a* to shift to a time setting mode and entering the present time.

For timer setting, the setting button 16*a* of the host unit 100 is pushed to shift to a timer setting mode. Furthermore, the scroll buttons 16*c* are used to select the electrical apparatus or the power supply control unit 400 (terminal unit 200) whose timer is to be operated, and timer operation time is set. Based on the clock of the host unit 100, at the set time, the host unit 100 orders the object terminal unit 200 to start or stop its operation by radio communication. Therefore, the electrical apparatus applicable to the system connected to the terminal unit 200 or the electrical apparatus non-applicable to the system connected to the power supply control unit 400 via the terminal unit 200 is operated based on the order.

In many of the existing electrical apparatuses excluding television sets and audio apparatuses, the timer is cleared when setting the timer. It is troublesome to have go to where the electrical apparatuses are installed to individually set the timers on a daily basis. In the present system, however, a timer time can be arbitrarily set on a plurality of electrical apparatuses by a simple timer setting operation using a single host unit 100.

Moreover, for an electrical apparatus requested to start or stop its operation at the same time every day, even if the electrical apparatus is not provided with the corresponding function, it may be set by selecting the electrical apparatus on the host unit 100 (or by selecting the electrical apparatus non-applicable to the system via the power supply control unit 400) in such a manner that its timer function can be continued. Additionally, since the host unit 100 incorporates the battery therein, the clock of the host unit 100 never stops, even at the time of service interruption. Moreover, even if the clock of the host unit 100 stops, only the clock of the host unit 100 needs to be reset, and it is unnecessary to set the time on each electrical apparatus.

As described above, the timer setting of the host unit 100 realizes a control in such a manner that, for example, an air conditioner, an electrical carpet, and an audio apparatus replacing an alarm clock are operated at the same time every morning and an electric rice cooker is operated at a predetermined time. Furthermore, when control is performed in such a manner that indoor lighting apparatuses are automatically turned on at a predetermined time in the evening, the crime prevention effect during absence can be enhanced. Conversely, the air conditioner, the electrical carpet and the lighting apparatus may be controlled to stop operation at a predetermined time. Electricity can be prevented from being inadvertently left on, and electricity saving and fire prevention can be realized.

Figure 10:
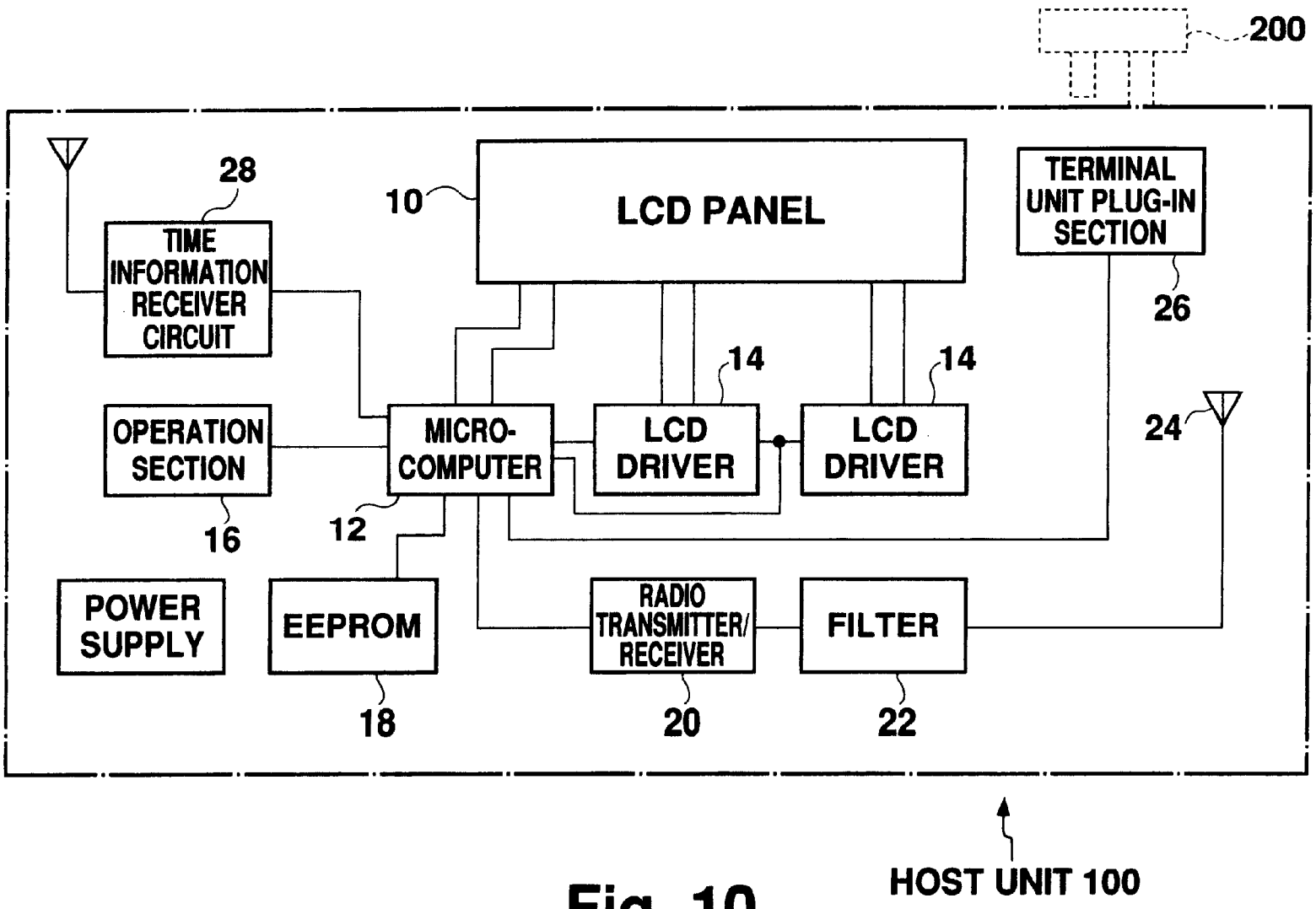
FIG. 10 is a block diagram showing a structure of a host unit provided with an automatic time adjustment function according to the embodiment.

In the present system, the host unit 100 can be provided with not only the aforementioned timer function but also a function of automatically setting its built-in clock to a correct time. FIG. 10 shows a structural example of the host unit 100 provided with such an automatic time adjustment function. Additionally, in FIG. 10, the same structure as in FIG. 2 is denoted with the same reference characters, and the description thereof is omitted.

At present, an announcement of time is transmitted using a radio broadcast (440 Hz, 880 Hz), at noon for example, and further standard radio waves indicative of a standard time are constantly transmitted. For example, the standard radio waves are transmitted from JJY station in Japan (5, 8, 10 MHz), and from WWV station (2.5, 5, 10, 15, 20 MHz), WWVH station (2.5, 5, 10, 15 MHz), and the like in the U.S. When the broadcast time information is received by a time information receiver circuit 28 and an internal clock is adjusted in accordance with the received time information, the clock in the host unit 100 can be operated at a correct time. Additionally, time adjustment does not need to be performed at all times. For example, the time information receiver circuit 28 may be activated based on the clock of the host unit 100 at the predetermined time once or several times in a day, and clock time adjustment may be performed based on the obtained time information.

Moreover, when each electrical apparatus is provided with an expanded function for the centralized control system as described later, the correct time information obtained by the time information receiver circuit 28 may be transmitted to the electrical apparatus via the terminal unit 200 by radio communication. As a result, for the electrical apparatus provided with the expanded function, the internal clock built therein can be adjusted by the obtained time information.

[Power Supply Batch Control]

In the present system, since the electrical apparatuses are centrally-controlled, a plurality of power supplies of the electrical apparatuses can be cut off together. At present, countermeasures against an earthquake are applied to electric stoves and the like, but not all electric stoves are provided with the countermeasures against earthquakes. Therefore, when an earthquake or another disaster happens, it is necessary to immediately cut off the power supply to the electrical apparatuses which might be heated or ignited, before taking refuge. However, since a large number of electrical apparatuses are used in houses or offices, it takes time to securely turn off each of the electrical apparatuses.

Here, electric power supply is controlled by a breaker within its control range, and all the power supply in the control range can be turned off by the breaker. However, the breaker is not automatically turned off unless leakage or a short occurs. Moreover, it is difficult to have access to the breaker, and the breaker is often installed where people seldom go. Therefore, in some cases it is not possible to turn off the breaker before taking refuge at the time of a disaster or emergency.

To cope with this, as shown in FIG. 3, the host unit 100 of the present system is provided with the all-off button 16*b* as an operation button. When the button 16*b* is pushed, the host unit 100 immediately and automatically transmits a control signal indicative of an order for turning off the electrical apparatus to each terminal unit 200 connected to the corresponding electrical apparatus. Therefore, unnecessary electrical apparatuses can be turned off together simply by pushing the operation button of the host unit 100.

Figure 11:
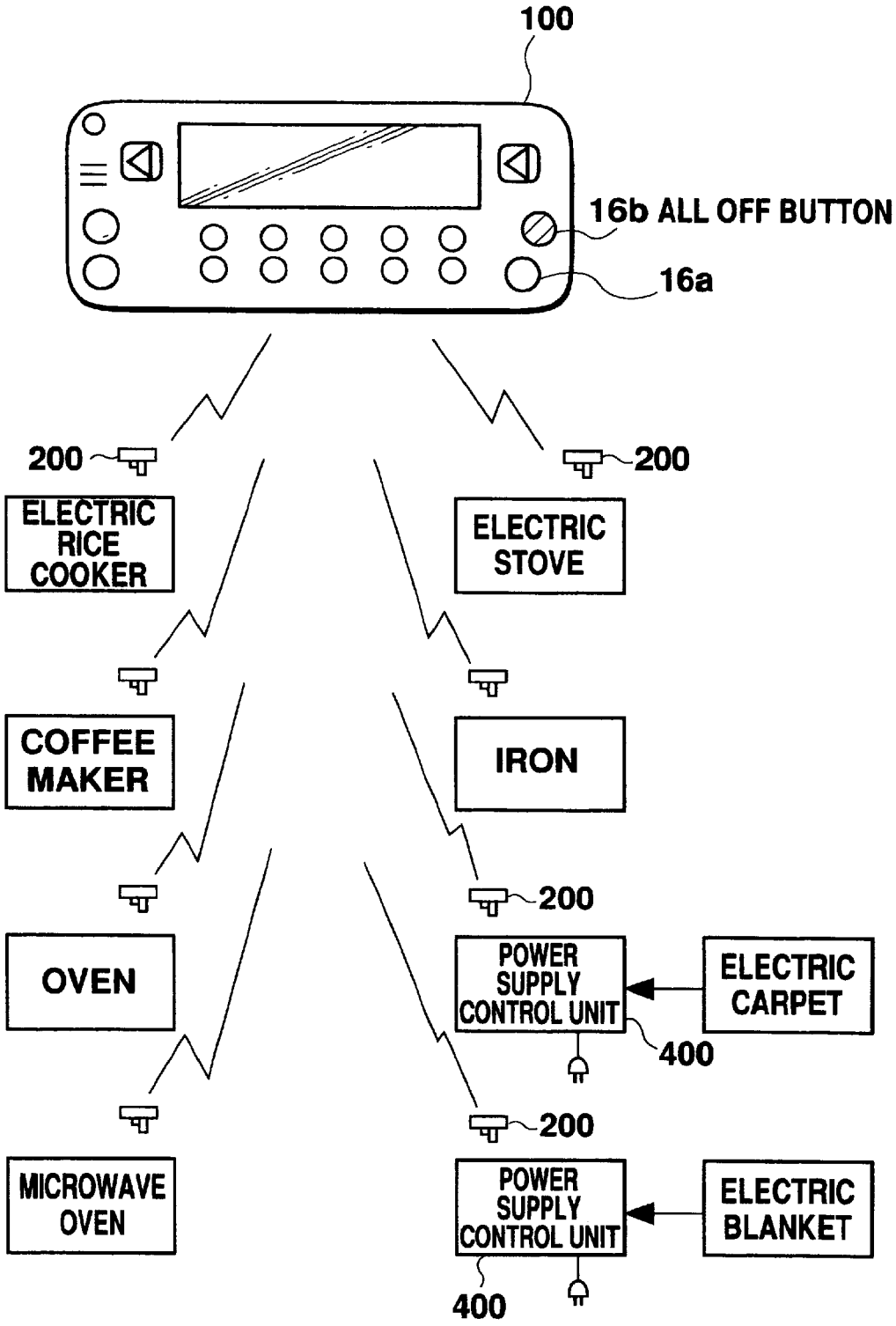
FIG. 11 is a schematic view showing an all power cutting-off operation according to the embodiment.

The electrical apparatuses to be controlled/turned off by the all-off button 16*b* can be set in the host unit 100 in advance. For example, as shown in FIG. 11, an electric rice cooker, an iron, an oven, an electric stove, and the like which might be heated or catch fire at the time of a disaster are set as the apparatuses to be controlled by the all-off button 16*b*. In this case, unnecessary electrical apparatuses can be controlled to turn off. Moreover, all the electrical apparatuses applicable to the system and power supply control units 400 for controlling the electrical apparatus non-applicable to the system, which are registered in the host unit 100, can be controlled/turned off together via the corresponding terminal units 200.

Furthermore, at the time of ID code registration of the terminal unit 200, the type of the electrical apparatus to be connected to the terminal unit 200 (e.g., electric stove, carpet, blanket or another heater) may be registered. In the case of such registration, when the all-off button 16*b* is pushed, the host unit 100 automatically selects the type of the apparatus to be controlled from the registered types of electrical apparatuses, and controls/turns off the selected apparatus.

When the host unit 100 having a portable structure is usually placed near at hand, for example, even in the case of an earthquake or other disaster or in an emergency while preparing for dinner in a cooking place, while in bed or while busy with something and being incapable of instantaneous movement, not only the nearby electrical apparatuses but also the electrical apparatuses in a separate room can instantly be turned off by pushing the all-off button 16*b* of the host unit 100 close at hand. Therefore, the electrical apparatuses can be securely prevented from being inadvertently left on.

The timer function usually automatically operated may be cleared by pushing the all-off button 16*b*. In the case of taking refuge from disaster, it seems to be undesirable that the timer function of the host unit 100 for daily use is operated to automatically activate the electrical apparatuses in an unmanned building. This problem can be avoided when all timer functions of apparatuses are cleared using the all-off button 16*b*.

Furthermore, in the case of disaster, while the unnecessary electrical apparatuses are controlled to turn off, for example, in order to smooth the operation of taking refuge, lighting apparatuses may be turned on by automatically performing radio communication from the host unit 100 to the corresponding electrical apparatuses when pushing the all-off button 16*b*.

The aforementioned all-off function may be used not only in the case of disaster but also when going outside, so that the unnecessary electrical apparatuses can be turned off together. This function can securely prevent the electrical apparatuses from being left on, and can also obviate the necessity of confirming whether each power supply of the electrical apparatus is turned on/off. Additionally, an operation button for exclusive use when going outside may be prepared separately. When the timer function is automatically cleared by pushing the all-off button 16*b*, a separate operation section for exclusive use when going outside is preferably provided.

A system for automatically detecting an earthquake to turn off the power supplies of electrical apparatuses together will next be described. When the earthquake occurs, it is not possible to push the all-off button 16*b* of the host unit 100. In this case, the system for automatically turning off the power supplies of electrical apparatuses together is provided, so that a fire or another secondary disaster can be prevented from being caused by the electrical apparatuses.

Figure 12:
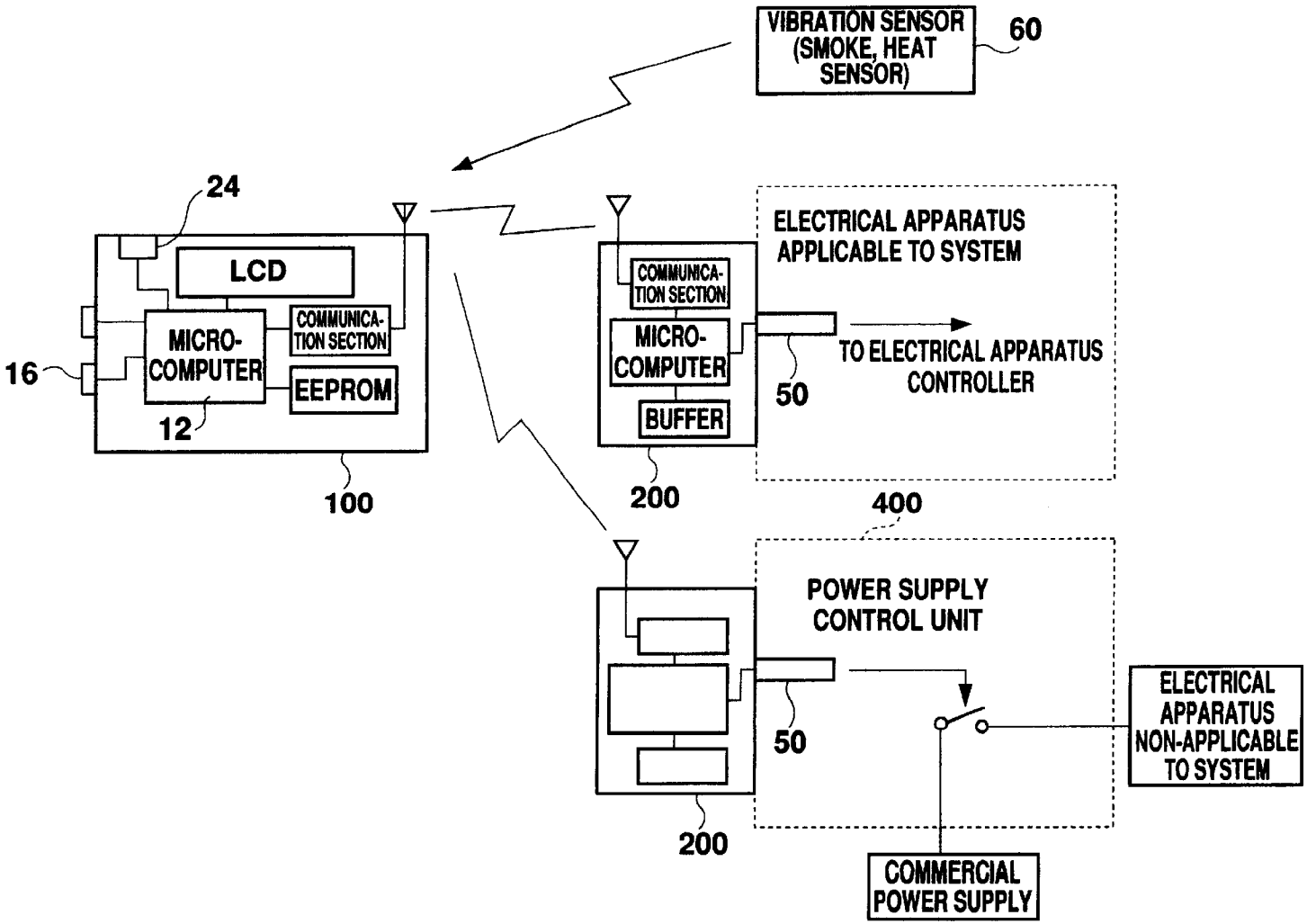
FIG. 12 is a schematic view showing an all power cutting-off system provided with an earthquake detecting function using a vibration sensor.

As shown in FIG. 12, the system can be realized, for example, by installing a vibration sensor 60 provided with a radio communication function. Upon detecting vibration of a predetermined level or more, the vibration sensor 60 notifies the host unit 100 by radio communication. Additionally, the vibration sensor 60 may be connected to the terminal unit 200 in the same manner as the electrical apparatus, so that the detection of vibration in the vibration sensor 60 is reported to the host unit 100 by radio communication between the connected terminal unit 200 and the host unit 100.

Figure 13:
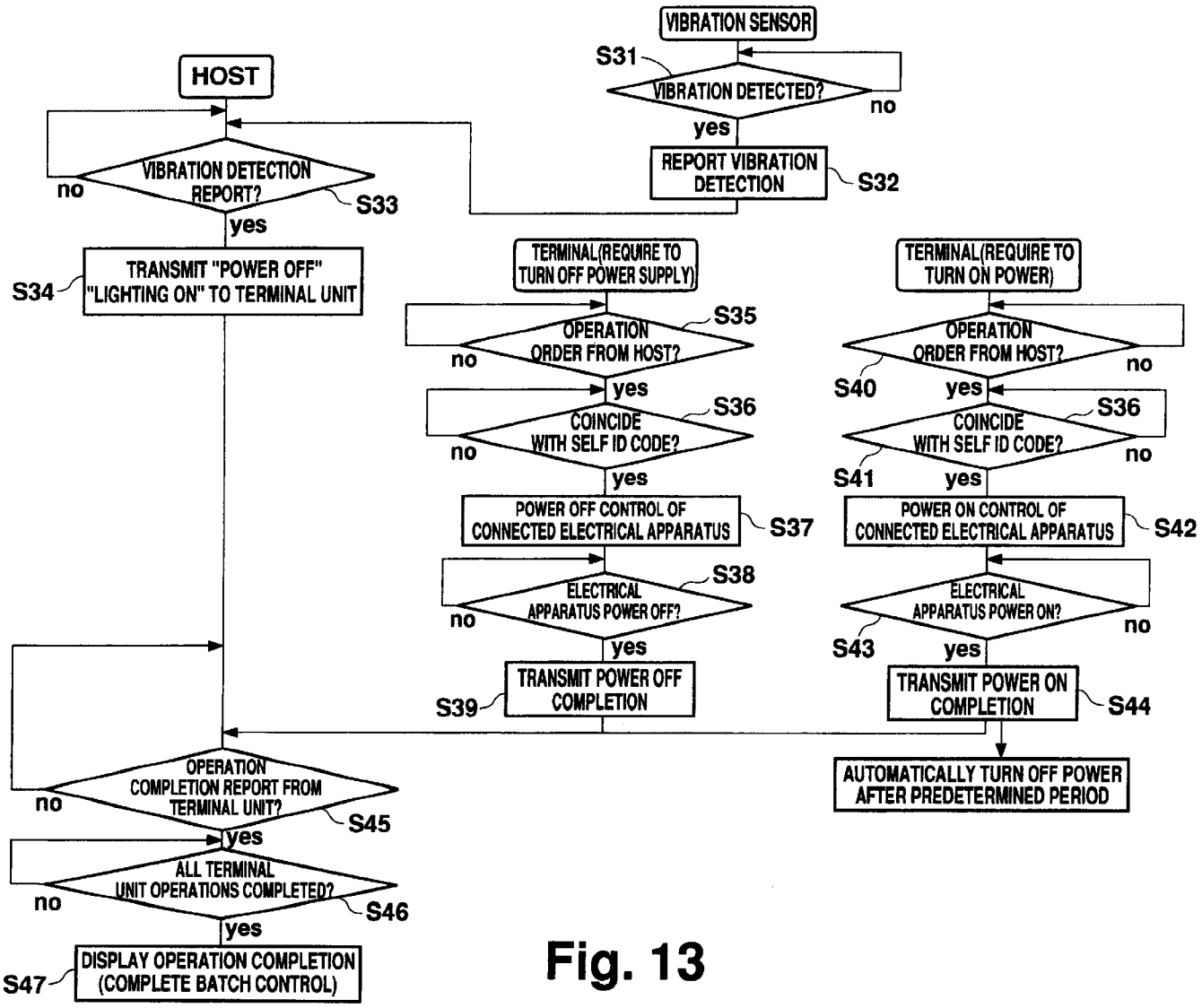
FIG. 13 is a flowchart showing procedure for batch-controlling electrical apparatuses by detecting an earthquake.

Operation procedure will next be described with reference to FIG. 13. When the vibration sensor 60 detects the vibration of a predetermined strength or more (yes in S31), a vibration detection report is transmitted to the host unit 100 by radio (S32). The host unit 100 receives the vibration detection report (S33). In this case (yes in S33), "power off" is automatically transmitted together with the ID code to the predetermined terminal unit 200 or the power supply control unit 400 connected to the electrical apparatus, for example, as shown in FIG. 1. Moreover, in order to prevent the confusion at the time of refuge, power on, i.e., "lighting on" is transmitted together with the ID code to the terminal unit 200 connected to the lighting apparatus (S34).

Upon receiving the control signal from the host unit 100 (S35, S40), the terminal unit 200 judges whether the ID code attached to the control signal coincides with the ID code of the terminal unit 200 (S36, S41). When ID codes coincide with each other and the control signal indicates that the connected electrical apparatus is to be controlled so as to turn off (yes in S36), the power supply of the corresponding electrical apparatus is turned off by outputting a power off signal via DATA terminal of the terminal 50. When ID codes coincide with each other and the control signal indicates that the connected electrical apparatus is to be controlled so as to turn on (yes in S41), the corresponding electrical apparatus, i.e., the lighting apparatus herein is turned on by outputting a power on signal via DATA terminal of the terminal 50. Additionally, when the lighting apparatus is not applicable to the system, power is supplied via the power supply control unit 400 to turn on the lighting apparatus. Moreover, when ID codes do not coincide with each other (no in S36 or S41), the terminal unit 200 does not operate.

After control is performed to turn the power supply of the electrical apparatus on or off, the terminal unit 200 judges via the signal obtained from its DATA terminal whether the electrical apparatus is actually turned on or off (S38, S43). When the electrical apparatus has been turned off based on the power off control (yes in S38), power off completion is transmitted to the host unit 100 (S39). Moreover, when the electrical apparatus (lighting apparatus) has been turned on based on the power on control (yes in S43), power on completion is transmitted to the host unit 100 (S44).

The host unit 100 monitors whether or not an operation completion report is transmitted from each terminal unit 200 (S45). When the operation completion report is transmitted (yes in S45), the host unit 100 judges whether operations of all terminal units 200 that were ordered to operate have been completed (S46). Subsequently, when the operations of the terminal units 200 which were ordered to operate have been completed (yes in S46), the host unit 100 indicates on its display panel 10 that the operations have been completed (S47), thereby completing the power supply batch control operation.

Additionally, when a predetermined time elapses after the lighting apparatus is controlled to turn on, the lighting apparatus can automatically be turned off, for example, by activating the timer function of the host unit 100. Moreover, in the procedure shown in FIG. 13, the lighting apparatus is turned on in the case of an earthquake, but it does not necessarily have to be turned on. In this case, only the unnecessary electrical apparatuses are controlled and turned off.

Here, when receiving the vibration detection report from the vibration sensor 60, the host unit 100 performs the predetermined control for each terminal unit 200, and further generates an alarm sound via a built-in speaker and lights an alarm lamp to inform people of the earthquake (refer to FIG. 3).

According to the system, for example, in case of an earthquake, even when people are busy attending to something, even in unmanned situation, or even when it is impossible to turn off the electrical apparatus before taking refuge, the unnecessary electrical apparatus can be turned off by automatically detecting the earthquake, so that a secondary disaster can be reliably avoided.

In the above description, the earthquake is detected by the vibration sensor 60, and the batch control of the electrical apparatuses is performed. However, the control is not limited to the earthquake. Instead of the vibration sensor 60 of FIG. 12, for example, a smoke sensor or a heat sensor may be provided. In this case, when a fire breaks out, the electrical apparatuses can be turned off together, and the fire can be prevented from spreading. Specifically, smoke or heat detection is reported from the sensor, the fire is recognized, and the alarm lamp is lit or the alarm sound is generated to urge people to evacuate. In the same procedure as shown in FIG. 13, the host unit 100 performs control to simultaneously turn off the power supplies of the electrical apparatuses such as a heating apparatus. Moreover, in order to facilitate the evacuation, control may be performed in such a manner that the lighting apparatus is lit for a predetermined period. Additionally, when the smoke sensor or the heat sensor is provided in addition to the vibration sensor 60, the power supplies of the necessary electrical apparatuses can be controlled in the case of both an earthquake and fire.

[Crime Prevention System Function]

Furthermore, in the centralized control system of the embodiment, the system can be provided with a crime prevention system function using a shock sensor, an infrared sensor, and the like. For a system structure, the vibration sensor of FIG. 12 is replaced with the shock sensor, and the shock sensor may be provided, for example, on a door, a window, or the like. Upon detecting that a shock of a predetermined level or higher has been applied to the door or the window, the shock sensor transmits a shock detection signal to the host unit 100. In order to inform people of the shock, the host unit 100 generates an alarm sound via a built-in speaker or lights an alarm lamp based on the shock detection signal (refer to FIG. 3). Moreover, in order to light a preset lighting apparatus, the host unit 100 transmits the ID code as well as a lighting on signal to the terminal unit 200 connected to the lighting apparatus. Thereby, the corresponding lighting apparatus can be lit. Furthermore, when the lighting apparatus is not applicable to the system, the power supply control unit 400 connected to the lighting apparatus is controlled via the terminal unit 200, so that the lighting apparatus can be lit.

According to the system, when someone invades a building via the door or the window, the invasion is automatically and quickly reported to people in the building. Additionally, the invader can be startled by lighting the lighting apparatus. Moreover, when an alarm applicable to the centralized control system is separately provided, the host unit 100 operates the alarm via the terminal unit 200 based on the shock detection signal to sound the alarm. As described above, when a shock is applied to the door or the window by the invader, the lighting apparatus is instantly lit, and the alarm is further sounded, so that a higher invasion inhibition effect can be obtained.

Moreover, the infrared sensor may be installed, for example, under the window, in a garden, at an entrance, or the like. When the host unit 100 is notified of detected human motion by the infrared sensor, a room lighting apparatus or an entrance lighting apparatus is lit via the terminal unit 200, and the alarm is further sounded to inhibit a person from invading. Moreover, when the lighting apparatus is automatically lit by detecting someone, and a chime is sounded in the building, or sound is emitted via the speaker of the host unit 100 to fulfill an interphone function, it is possible to respond smoothly to guests.

Moreover, the system is not limited to the structure in which the host unit 100 for performing centralized control of the electrical apparatuses as shown in FIG. 1 receives the detection signal from the shock sensor or the infrared sensor to operate.

Figure 14:
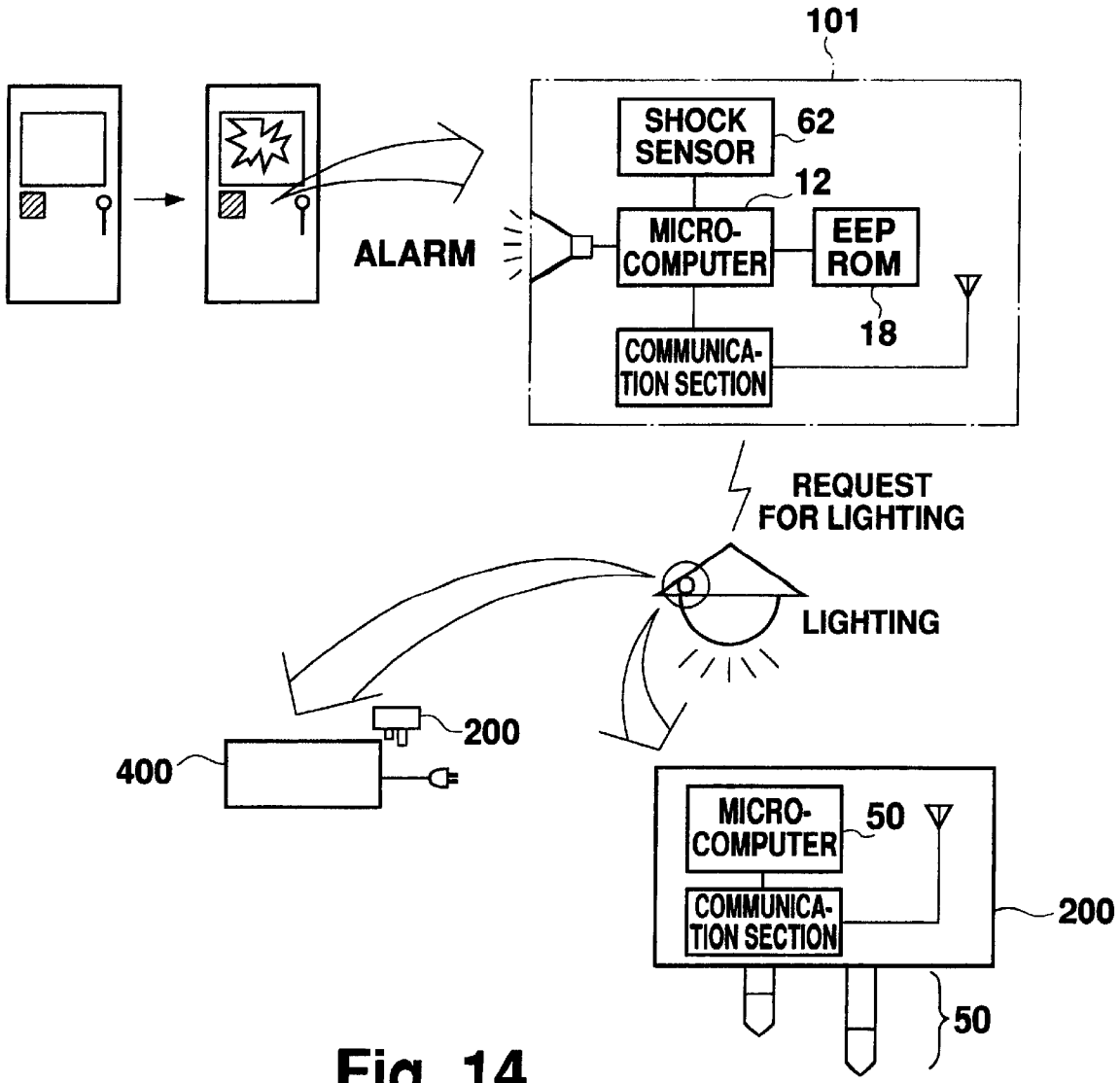
FIG. 14 is a schematic view showing a structural example of a system provided with a crime prevention function.

As shown in FIG. 14, an exclusive-use host unit 101 with a shock sensor 62 built therein may be separately prepared, and a predetermined lighting is lit under control of the exclusive-use host unit 101. In this case, the ID code of the terminal unit 200 of the electrical apparatus to be operated when a predetermined shock or motion is detected is registered beforehand in the exclusive-use host unit 101. When the shock sensor 62 of the exclusive-use host unit 101 detects the shock, the exclusive-use host unit 101 gives an order for operation to the necessary electrical apparatus (lighting apparatus or the like) via the terminal unit 200. When the object electrical apparatus is not applicable to the system, the power supply control unit 400 is controlled via the terminal unit 200, thereby operating the electrical apparatus.

The use of the exclusive-use host unit 101 for crime prevention alleviates the processing burden of the host unit 100 for performing centralized control of many general electrical apparatuses as shown in FIG. 1. Therefore, the host unit 100 which is portable, fast in processing, small in the number of items to be processed and inexpensive is provided, while the crime prevention system function can be additionally provided by the exclusive-use host unit 101. Moreover, instead of controlling the terminal unit 200 directly by the exclusive-use host unit 101, shock detection is notified once to the host unit 100 by the exclusive-use host unit 101, and the predetermined lighting apparatus or the like may be lit by the host unit 100.

Furthermore, the shock sensor 62 may not necessarily be incorporated in the exclusive-use host unit 101. The shock sensor 62 may be plugged into the terminal unit 200 in the same manner as the electrical apparatuses. In this case, the shock detection is transmitted to the host unit 100 or 101 via the terminal unit 200.

[Power Saving System]

Figure 15B:
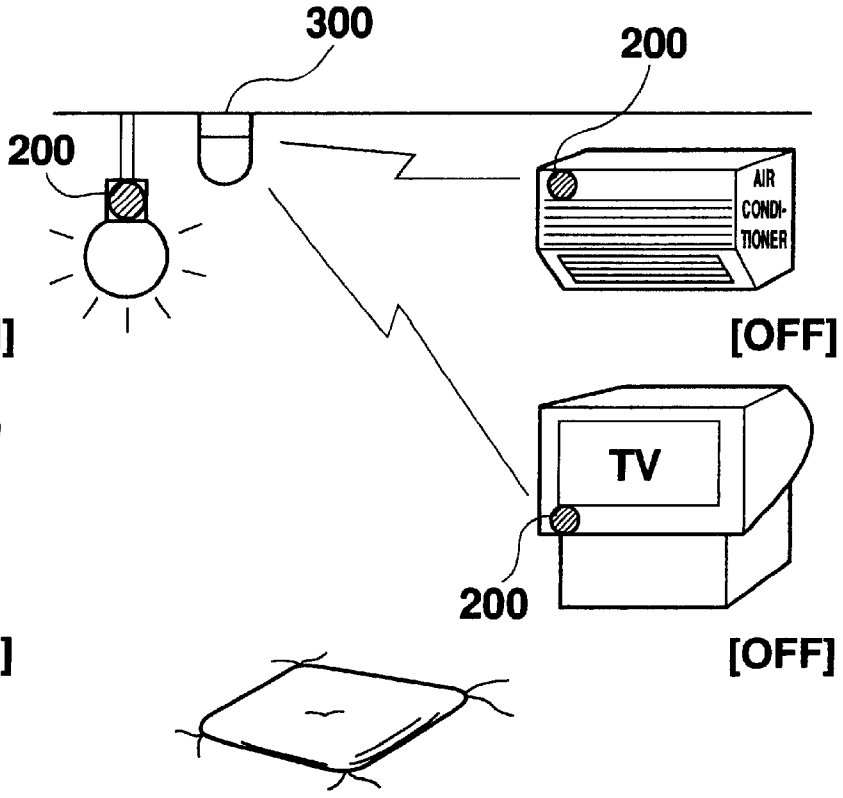
FIGS. 15A and 15B are schematic views showing an operational example of a system provided with a power saving function.
Figure 15A:
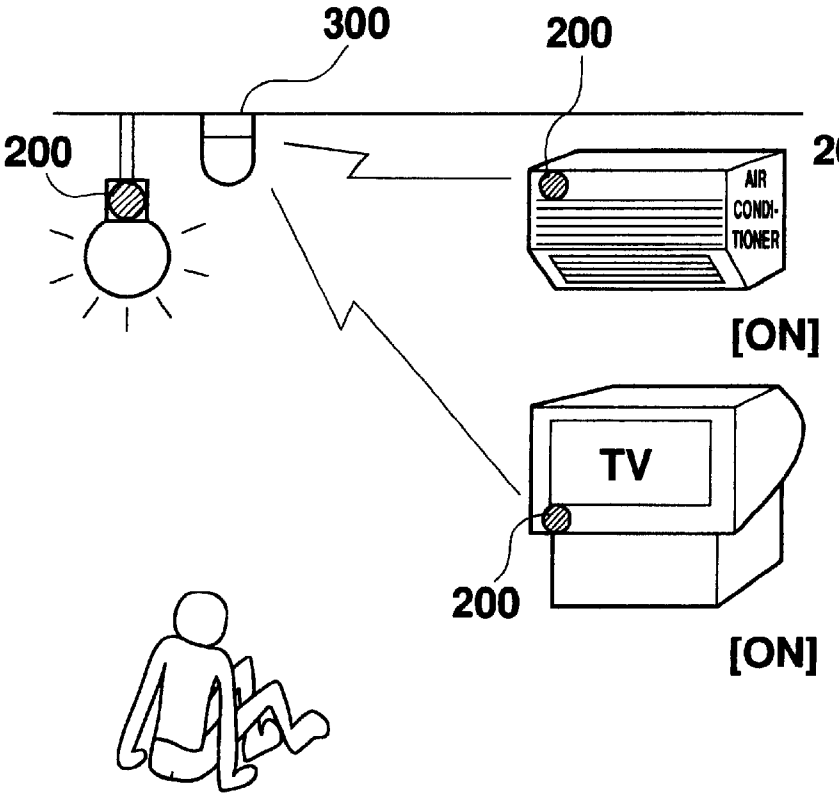
Figure 16:
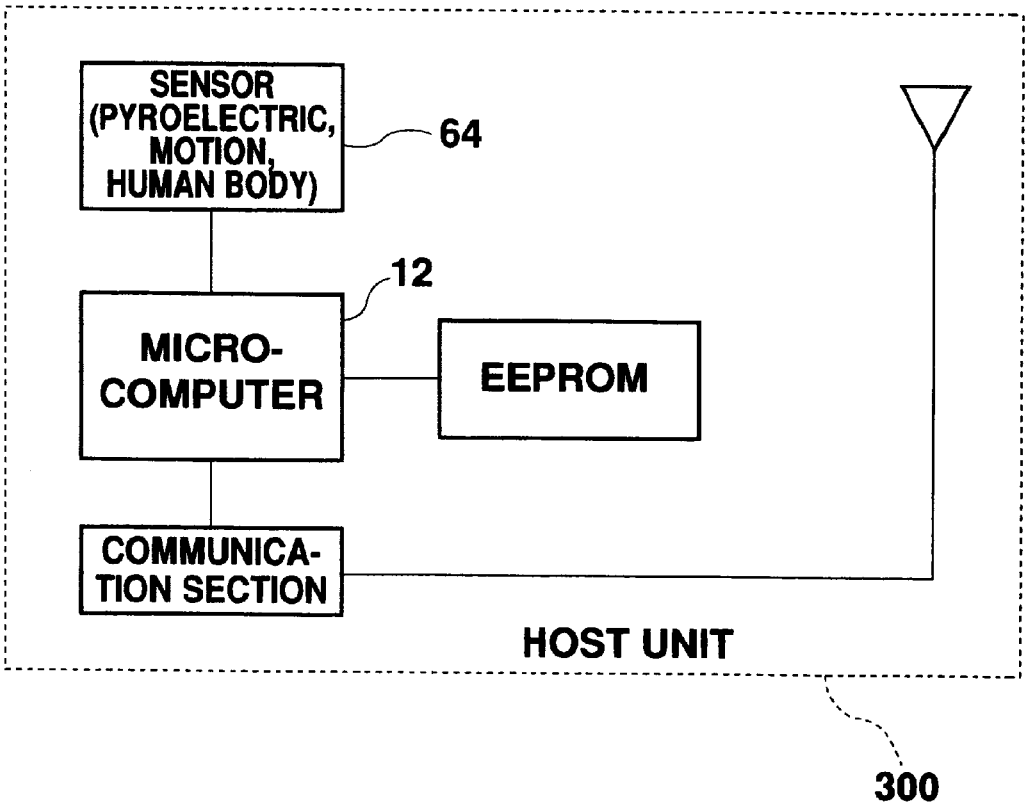
FIG. 16 is a view showing a structure example of a host unit 300 in the system of FIG. 15.

The aforementioned system can be operated in order to save electric power. For example, as shown in FIGS. 15A, 15B, a room may be equipped with an air conditioner, a television set and a lighting apparatus, and these electrical apparatuses are connected to the terminal units 200 as described above. The electrical apparatus non-applicable to the system is connected to the power supply control unit 400, which is then connected to the terminal unit 200. Moreover, a host unit 300 as shown in FIG. 16 is mounted on a wall or a ceiling in the room. The host unit 300 incorporates therein a pyroelectric sensor, a motion sensor, a human body sensor, or another sensor 64. Additionally, the ID code of the terminal unit 200 to be controlled in the room is registered in EEPROM.

The host unit 300 detects using the sensor 64 whether or not someone is in the room. As shown in FIG. 15A, when someone is in the room and human motion is detected by the sensor 64, the host unit 300 transmits signals to the registered terminal units 200 to turn on the electrical apparatuses. In the event that any electrical apparatus has already been turned on, its on state is maintained.

As shown in FIG. 15B, when nobody is in the room and the detection of human motion by the sensor 64 is not performed for a predetermined period (e.g., 15 minutes), the microcomputer 12 transmits signals to the registered terminal units 200 by radio to turn off the electrical apparatuses. Upon receiving the signals, the terminal units 200 turn off the corresponding electrical apparatuses.

By the aforementioned control, when nobody is in the room, the unnecessary electrical apparatuses can automatically be turned off. Therefore, electricity can be prevented from being left on and being wasted, or a fire can be prevented from breaking out because of the electricity that has not been turned off. On the other hand, when someone enters the room, the sensor 64 instantly detects that it to perform the power on control of the registered electrical apparatus. Therefore, the necessary electrical apparatus is prevented from being turned off, or the electrical apparatus can function as the crime prevention system.

Additionally, in the above description, the exclusive-use host unit 300 with the sensor incorporated therein is installed in the room, and the terminal units 200 are controlled by the host unit 300. However, the present invention is not limited to this structure. For example, a sensor provided with a radio communication function or a sensor with the terminal unit 200 connected thereto may be installed in the room. In this case, a detection result of the sensor is transmitted to the common host unit 100 in the building as shown in FIG. 1. The host unit 100 transmits a control signal based on the detection result of the sensor 64 to the predetermined terminal unit 200 to be controlled in the room equipped with the sensor 64. Even in this method, the unnecessary electrical apparatuses can be turned off. Additionally, the host unit can be operated usefully for crime prevention by turning off the power supply immediately after human motion is detected.

[Expanded Function of Centralized Control System]

A method of judging whether the electrical apparatus is provided with an expanded function in the centralized control system of the embodiment will next be described.

When the electrical apparatus is provided with the expanded function, not only the turning on/off of the power supply of the electrical apparatus but also more detailed items can be controlled by the host unit 100. When the electrical apparatus provided with the expanded function is an air conditioner, for example, the setting of in-room temperature, and switching of heating/cooling can be controlled via the host unit 100. When it is a video device, for example, the clock adjustment, recording reservation, channel adjustment, or the like of the video device can be controlled.

In the present system, when the terminal unit 200 is plugged into the plug-in section 40 of the electrical apparatus, it can be automatically known via the DATA terminal of the unit 200 whether the electrical apparatus is provided with the expanded function.

Figure 17:
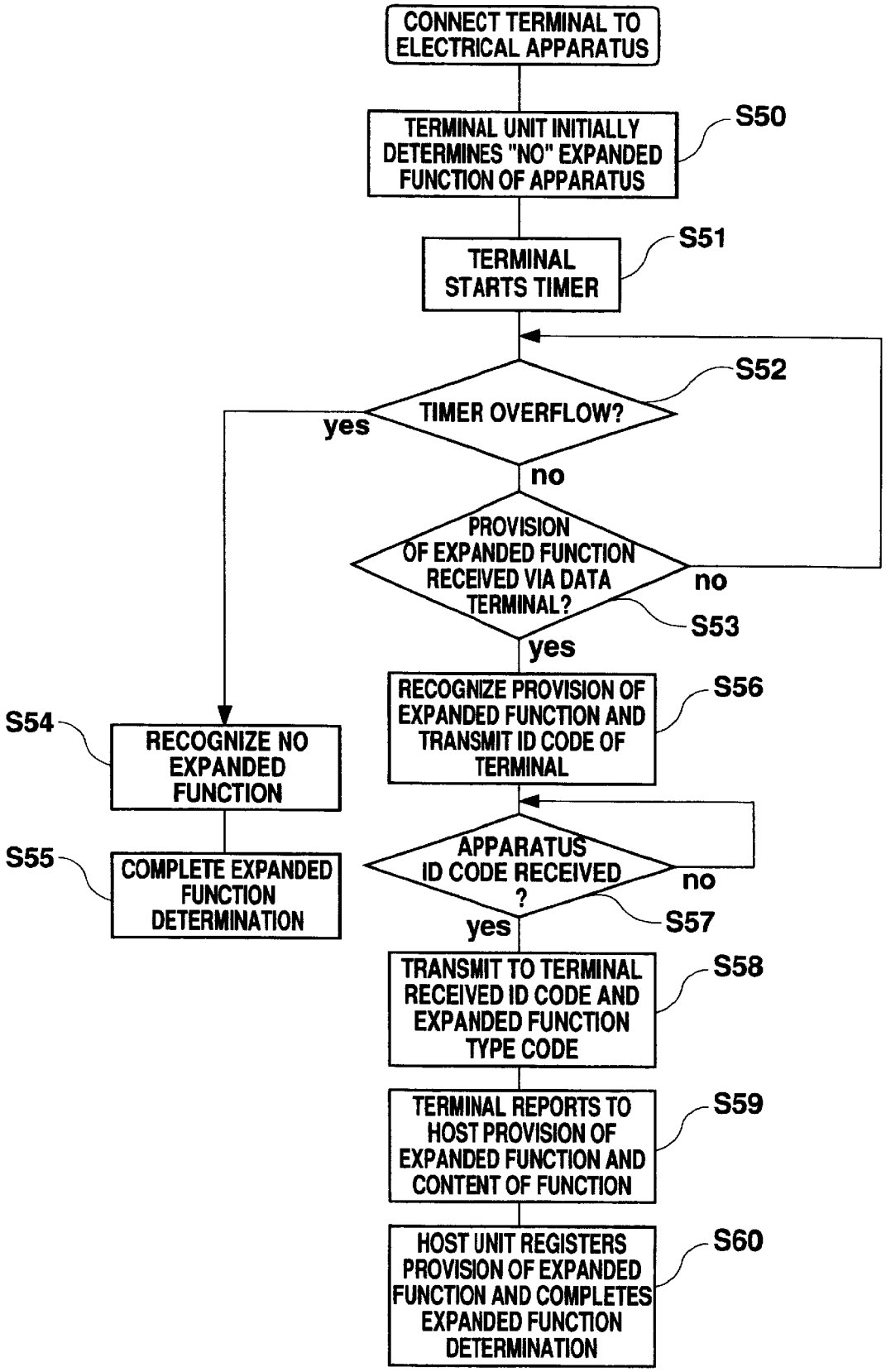
FIG. 17 is a flowchart showing procedure for determining an expanded function of the electrical apparatus.

A determination method will be described hereinafter in detail with reference to FIGS. 17, 18. First, the terminal unit 200 whose ID code has been registered is connected to the terminal plug-in section 40 provided on the apparatus to be determined. In this case, the terminal unit 200 initially determines once that the apparatus to be determined is provided with no expanded function (S50). When attached to the apparatus to be determined, the terminal unit 200 starts the timer (S51). When the apparatus to be determined is provided with the expanded function, the apparatus detects the connection of the terminal unit 200 and informs the terminal unit 200 of a digital code indicating that the apparatus is provided with the expanded function (expanded function mounted code) via the DATA terminal of the terminal unit 200, before the timer of the terminal unit overflows (no in S52). Moreover, when the expanded function is not provided, no expanded function mounted code is transmitted from the apparatus to be determined during the timer period. Therefore, after the predetermined period elapses, the timer overflowing is detected (yes in S52), the terminal unit 200 recognizes that the apparatus is provided with no expanded function (S54), and the expanded function determination is completed (S55).

Figure 18A:
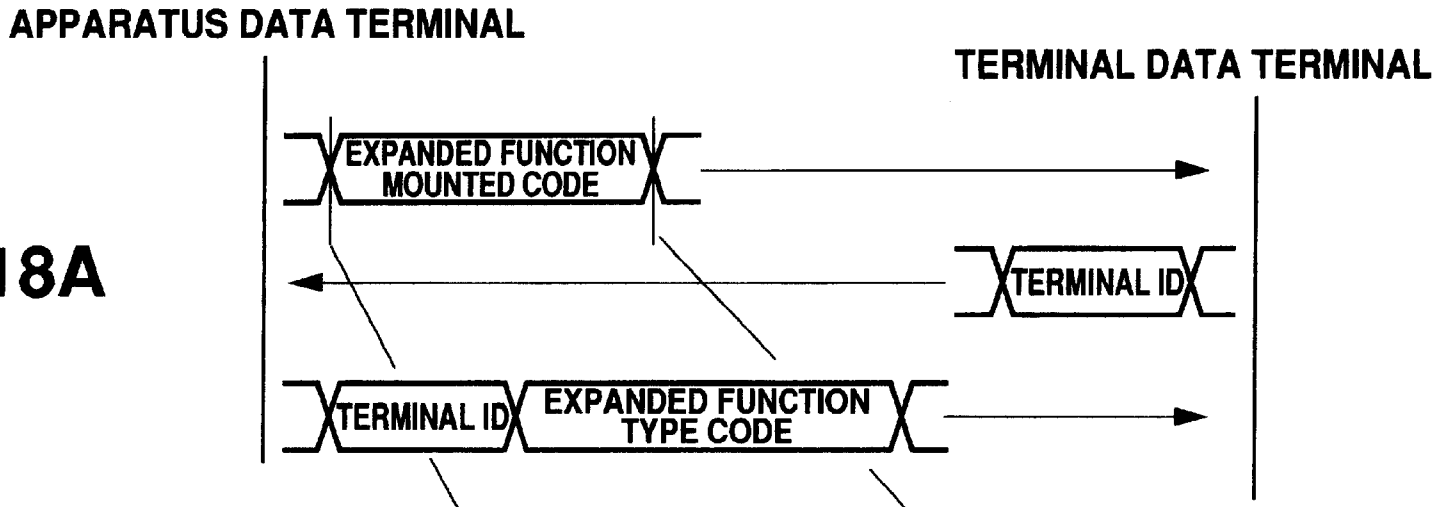
FIGS. 18A and 18B are views showing a communication method for determining the expanded function between electrical apparatus and terminal unit.
Figure 18B:
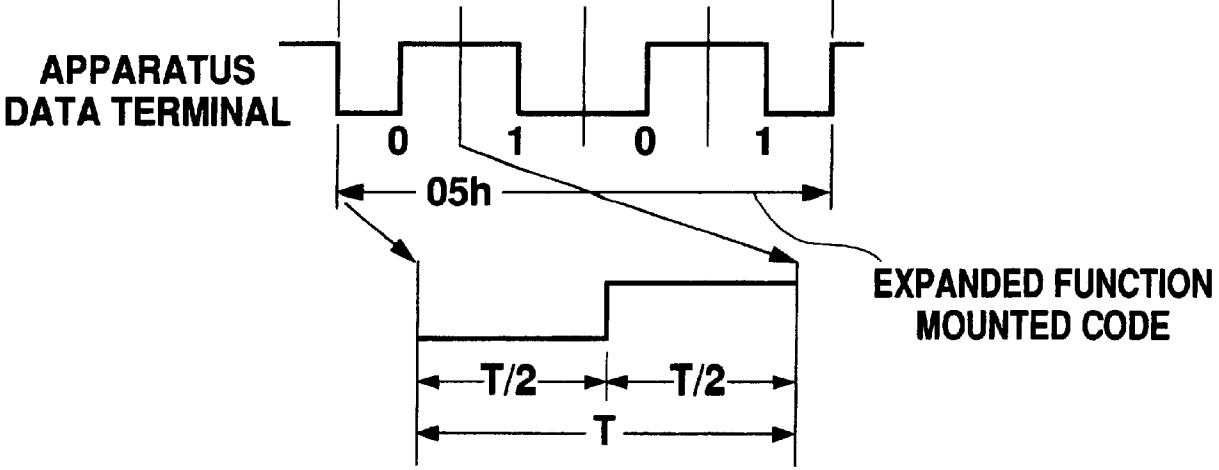

Additionally, as shown in FIG. 18A, for communication of the apparatus to be determined and the terminal unit 200, non-synchronous serial communication is performed with a simple circuit structure. Moreover, the expanded function mounted code transmitted from the apparatus is, for example, 05h as shown in FIG. 18B, in which "1" or "0" is indicated in accordance with a change in data every T/2 period within period T (provided that the indication method is not limited).

During the period of measuring the timer, upon receiving the expanded function mounted code from the apparatus to be determined (yes in S53), the terminal unit 200 transmits its ID code to the apparatus to be determined via the DATA terminal (S56).

Upon receiving the ID code from the terminal unit 200 (yes in S57), the apparatus to be determined transmits to the terminal unit 200 the received ID code and an expanded function type code indicating the content of the expanded function (S58). When the ID code and the expanded function type code are transmitted from the apparatus to be determined, the terminal unit 200 confirms the coincidence of the ID code. If the coincidence is not confirmed, the process returns to the transmission of ID code. If the coincidence is confirmed, the terminal unit 200 reports to the host unit 100 the expanded function mounted code and expanded function type code of the apparatus to be determined as well as the internal ID code using radio communication (S59). Upon receiving the expanded.function mounted code and the expanded function type code from the terminal unit 200, the host unit 100 judges that the apparatus connected to the terminal unit 200 is provided with the expanded function, and also registers the function content indicated by the expanded function type code in EEPROM incorporated therein (S60).

As described above, when the terminal unit 200 is plugged into the control object or electrical apparatus, it is automatically determined whether or not the apparatus is provided with the expanded function. When the apparatus is provided with the expanded function, the content of the function is reported and registered to the host unit 100. Therefore, the user does not need to perform an intricate operation for separately registering the information regarding the expanded function to the host unit. The apparatus can be controlled using the expanded function simply by connecting the terminal unit 200 to the apparatus. Moreover, since it is determined using the DATA terminal of the terminal unit 200 as described above whether or not the electrical apparatus is provided with the expanded function, the terminal unit 200 does not need to be provided with a terminal exclusively for the determination of the expanded function. The number of poles of the terminal 50 of the terminal unit can thus be minimized.

[System having a Plurality of Host Units]

In the above description, the structure in which a plurality of electrical apparatuses (terminal units 200) are centrally-controlled by a single host unit 100 has been illustrated, but a plurality of host units 100 may be provided. For example, like the relationship between a master phone and branch phones, the host unit 100 can limit the functions of the other host units 100 as branch units. Alternatively, all the host units 100 may be provided with the same function and authority.

When a plurality of host units 100 are provided, an operation for registering the ID code of the terminal unit 200 to each host unit 100 needs to be separately performed. Specifically, when the same terminal unit 200 is controlled by a plurality of host units 100, the terminal unit 200 is plugged directly into each host unit 100 as described above to perform the ID code registration operation. Additionally, since the ID code already registered to the predetermined host unit 100 can be copied to another host unit 100 by radio communication or the like, a redundant ID code registration operation can be omitted.

When operating properties are considered, the host unit 100 preferably incorporates a power supply and is made portable. Alternatively, while one of a plurality of host units 100 is placed in a determined place, the other host units may be carried by operators. In this mode, the host units are easy and practical to use.

Additionally, the authority of a plurality of host units 100 in the control of the same terminal unit 200 remains the same unless it is especially limited. When orders for the same terminal unit 200 overlap, the terminal unit 200 operates based on the latest control order, and the signal from the terminal unit 200 is received by each host unit 100 in which the terminal unit 200 is registered.

Moreover, if a disaster occurs, the operation of pushing the all-off button 16*b* of the host unit 100 is performed as described above. Even when remote from a house where the system is installed, the power off control of the electrical apparatuses can be performed at the distance of, for example, about 30 to 100 m from the house. Therefore, people can evacuate carrying the host units 100. Here, if the host unit 100 for use in case of emergency is equipped with a lighting function and/or a radio receiving function, the host unit 100 can easily be operated, for example, at the time of a night disaster. The evacuation path can be illuminated, or disaster circumstances can be made known by radio. The system of the present invention can thus be convenient and functional as a disaster prevention countermeasure.

[Control of Electrical apparatus non-applicable to System]

As shown in FIG. 1, when there is an electrical apparatus non-applicable to the system among the electrical apparatuses to be incorporated in the control system, the power supply control unit 400 is used, which can control the power supply to the electrical apparatus.

Figure 19:
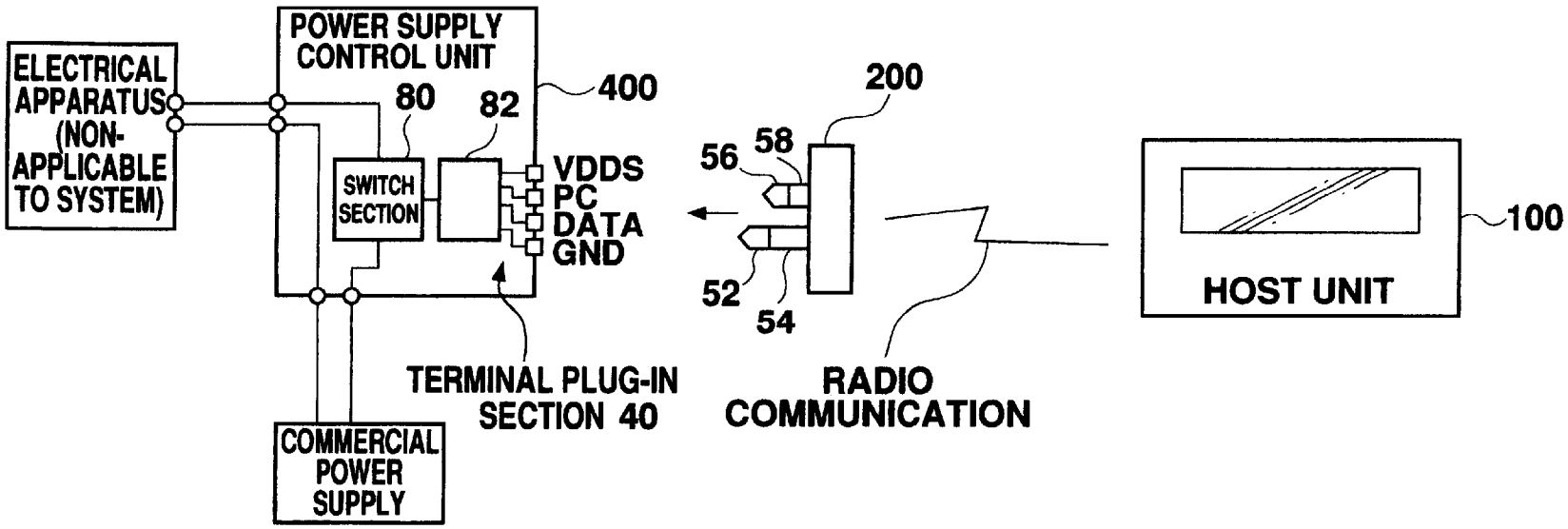
FIG. 19 is a view showing a system for controlling an electrical apparatus non-applicable to the system and a structure of a power supply control unit.

As shown in FIG. 19, the power supply control unit 400 comprises the terminal plug-in section 40. The same terminal unit 200 as the terminal unit 200 connected to the electrical apparatus applicable to the system can be plugged in the terminal plug-in section 40. Moreover, the power supply control unit 400 comprises a supply path for supplying electric power from a commercial power supply to an AC power plug socket of the electrical apparatus, a switch section (relay) 80 provided in the supply path for switching on or off the supply path, and a power controller 82 for controlling the opening/closing of the switch section 80 in accordance with the control signal from the connected terminal unit 200.

The terminal unit 200 connected to the power supply control unit 400 has the same structure as that of the terminal unit 200 connected to the electrical apparatus applicable to the system, and its ID code is registered in the host unit 100 in the same procedure. After the ID code is registered in the host unit 100, the terminal unit 200 is plugged into the power supply control unit 400 to which the power plug of the electrical apparatus non-applicable to the system to be controlled is connected. Therefore, the power supply control unit 400 is controlled via the terminal unit 200 in the same manner as the electrical apparatus applicable to the system. As a result, the electrical apparatus non-applicable to the system is controlled by the host unit 100 via the power supply control unit 400 and the terminal unit 200.

Moreover, the communication between the terminal unit 200 connected to the power supply control unit 400 and the host unit 100 is performed in the same manner as the communication between the terminal unit 200 connected to the electrical apparatus applicable to the system and the host unit 100. Therefore, according to the present system, even the electrical apparatus non-applicable to the system can be controlled by the radio communication between the host unit 100 and the terminal unit 200 and by the power supply control unit 400, so that wiring work or the like does not need to be applied in the building.

The terminal unit 200, which is connected to the power supply control unit 400 after its ID code is registered to the host unit 100, can be prepared to receive control signals from the host unit 100 at all times. Subsequently, upon receiving the control signal with its ID code attached thereto from the host unit 100, the terminal unit 200 recognizes that the control signal is transmitted to itself. This is reported to the power supply control unit 400 via the terminal unit 200, and the power supply control unit 400 opens/closes its switch section 80 in response to the control signal.

Here, the terminal unit 200 connected to the power supply control unit 400 can not directly know the state of the electrical apparatus. However, the opening/closing state of the switch section 80 of the power supply control unit 400 may be known. In this case, the opening/closing state of the switch section 80 is reported to the host unit 100.

Upon receiving the report of the opening/closing state of the switch section 80, for example, the host unit 100 can indicate "unit off" on the display 10 when the switch section 80 is opened and the power supply to the electrical apparatus is turned off, and can indicate "unit on" when the switch section 80 is closed and the power supply to the electrical apparatus is turned on.

[0033]

When the switch section 80 of the power supply control unit 400 is opened to make the power supply path between the commercial power supply and the electrical apparatus non-conducting, no operation power is supplied. Therefore, the electrical apparatus is turned off. On the other hand, when the switch section 80 is closed and electricity is conducted in the power supply path, the operation power is supplied, and the electrical apparatus is turned on, except in a case where the power supply is turned off on the side of the electrical apparatus. The opening and closing states of the switch section 80 of the power supply control unit 400 are regarded as the off and on states of the electrical apparatus, respectively. The host unit 100 can judge the opening or closing state obtained from the power supply control unit 400 via the terminal unit 200 as the off or on state of the apparatus connected to the power supply control unit 400, and display "some apparatus off" or "some apparatus on".

Additionally, when the terminal unit 200 connected to the power supply control unit 400 cannot directly detect the opening/closing state of the switch section 80 in the power supply control unit 400, the terminal unit 200 may regard its switching on/off control signal supplied to the switch section 80 of the power supply control unit 400 as the opening/closing state of the switch section 80, and report the state to the host unit 100.

[Detection of Electrical apparatus State by Power Supply Control Unit]

In the structure of FIG. 19, the terminal unit 200 connected to the power supply control unit 400 only detects the opening/closing of the switch section 80 provided in the path to the electrical apparatus non-applicable to the system from the commercial power supply, and cannot directly detect the power supply state of the electrical apparatus. When the switch section 80 of the power supply control unit 400 is open, the power supply from the commercial power supply is cut off, and the electrical apparatus is turned off. The open state of the switch section 80 corresponds to the off state of the electrical apparatus. However, when the switch section 80 is closed and the power switch of the electrical apparatus unit is turned off (switch open), the electrical apparatus is placed in off state. Therefore, the closed state of the switch section 80 does not necessarily coincide with the on state of the electrical apparatus. When the switch section 80 of the power supply control unit 400 is closed and the switch of the electrical apparatus unit is turned off (open), this cannot be detected by the structure of FIG. 19.

Figure 20:
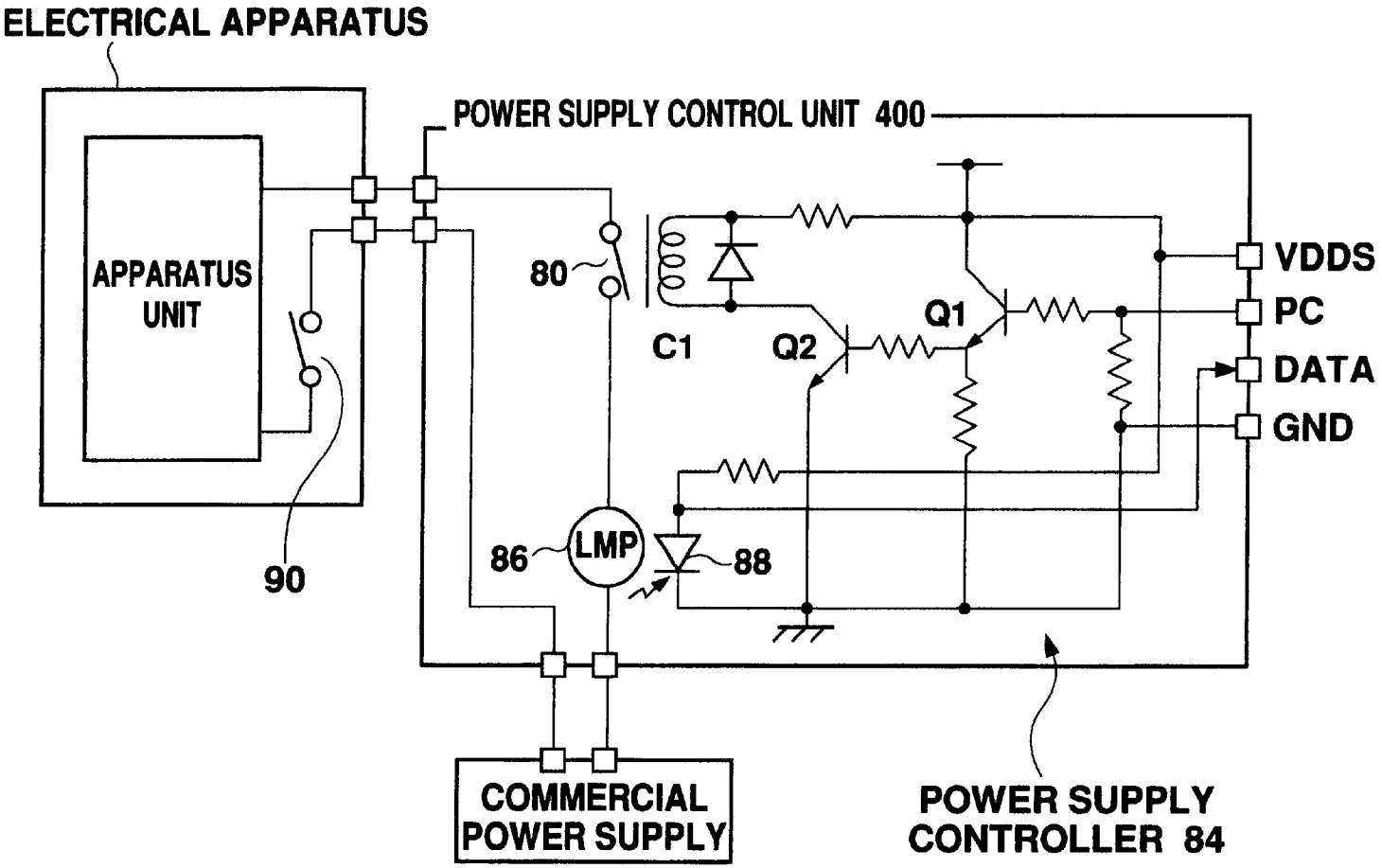
FIG. 20 is a view showing a structure for detecting a power state of the electrical apparatus by the power supply control unit.

FIG. 20 shows a structure of the power supply control unit 400 for detecting the on/off state of the electrical apparatus in the above circumstances. The power supply control unit 400 comprises a switch section 80 provided in a supply path between a commercial power supply and an electrical apparatus for controlling conducting/non-conducting of the supply path, and a light emitting element 86 for emitting light in accordance with the on/off state of the supply path. The power supply control unit 400 further comprises a power supply controller 84 for controlling the opening/closing of the switch section 80 in response to a control signal from the connected terminal unit 200 and for detecting the on/off state of the supply path based on the light emitting of the light emitting element 86. The power supply controller 84 comprises a coil C1 for switch control, two-stage transistors Q1, Q2 for operating the coil C1, and a photodiode 88 for operating in response to the light emitting of the light emitting element 86.

When connected to the power supply control unit 400, the terminal unit 200 recognizes the connection, and outputs a control signal for controlling the coil C1 via the PC terminal based on an instruction from the host unit 100. When the control signal of a predetermined level H is supplied to the PC terminal, the transistor Q1 amplifies the electric current of the control signal, and the transistor Q2 is operated by the amplified current to pass the current through the coil C1. When the current is passed through the coil C1, the switch section 80 is opened, and the power supply path to the electrical apparatus is placed in a non-conducting state. Moreover, when the control signal of a predetermined level L is supplied to the PC terminal, the transistors Q1, Q2 are turned off, no electric current is passed through the coil C1, and the switch section 80 is closed. As a result, the power supply path to the electrical apparatus is placed in a conducting state.

Here, when the switch section 80 is closed and a power switch 90 of the electrical apparatus connected to the power supply control unit 400 is in on state (switch closed state), the power supply path between the commercial power supply and the electrical apparatus is placed in a conducting state. Therefore, the light emitting element 86 is operated to emit light, and the photodiode 88 detects the light to turn on.

On the other hand, when the power switch 90 of the electrical apparatus is in the off state (switch open state), the power supply path between the commercial power supply and the electrical apparatus becomes non-conducting even if the switch section 80 is closed. Therefore, neither the light emitting element 86 nor the photodiode 88 is operated.

The anode side of the photodiode 88 is connected to DATA terminal. Therefore, if the photodiode 88 is operated to change the electric potential of DATA terminal, this situation is transmitted to the terminal unit 200 via DATA terminal. The terminal unit 200 can thus detect the conducting/non-conducting of the power supply path, i.e., the actual on/off state of the electrical apparatus via DATA terminal.

The detected on/off state of the power supply of the electrical apparatus is transmitted to the host unit 100 via the terminal unit 200 connected to the power supply control unit 400, and the host unit 100 can know the power supply state of the electrical apparatus. Moreover, when the host unit 100 transmits a control signal to the terminal unit 200 in accordance with the obtained power supply state, the corresponding control signal is transmitted to the power supply controller 84 of the power supply control unit 400 from the terminal unit 200. Therefore, the conducting/non-conducting of the power supply path is controlled in accordance with the control signal, and finally the power supply of the control object or electrical apparatus is controlled. As described above, the power supply state of the electrical apparatus non-applicable to the system can be detected and controlled from the host unit 100 via the terminal unit 200 and the power supply control unit 400 by providing the power supply control unit 400 with the structure in which the conducting/non-conducting of the power supply path is detected and transmitted to the terminal unit 200.

Additionally, the power supply control unit 400 is not limited to the circuit structure shown in FIG. 20, and can have any circuit structure as long as the conducting/non-conducting of the power supply path between the commercial power supply and the electrical apparatus is controlled and the situation can be detected. Moreover, in the circuit structure of FIG. 20, the switch section 80 is controlled using PC terminal of the terminal unit 200, but the switch section 80 may be controlled based on the control signal from DATA terminal.

What is claimed is:

1. A system for centrally controlling a plurality of electrical apparatuses comprising:

a centralized apparatus control device and a controlled apparatus terminal device, said controlled apparatus terminal device being registered in the centralized apparatus control device and disposed for each of said plurality of electrical apparatuses as control objects, radio communication being performed between said centralized apparatus control device and said controlled apparatus terminal device registered in the centralized apparatus control device to control the corresponding electrical apparatus via the controlled apparatus terminal device, wherein the controlled apparatus terminal device is provided separately from the electrical apparatuses and is removable therefrom.

2. The system according to claim 1, wherein said controlled apparatus terminal device comprises:

a transmitter/receiver for transmitting a state signal of said corresponding electrical apparatus to said centralized apparatus control device and for receiving a control signal from said centralized apparatus control device; and a terminal controller for generating an apparatus control signal in accordance with said received control signal to transmit the apparatus control signal to said corresponding electrical apparatus and for detecting a state of said connected electrical apparatus to generate said state signal.

3. The system according to claim 1, wherein said controlled apparatus terminal device comprises a single data communication terminal for exchanging signals with the control object or electrical apparatus, and the data communication terminal is used to transmit said generated apparatus control signal to said connected electrical apparatus and to detect the state of the electrical apparatus and the presence of an expanded control function as a function to be controlled regarding a particular item by the system.

4. The system according to claim 1, wherein each of individual ID codes attached beforehand to said controlled apparatus terminal devices is registered in said centralized apparatus control device.

5. The system according to claim 1, wherein when said controlled apparatus terminal device is connected to a terminal plug-in section, said centralized apparatus control device reads the ID code attached beforehand to said controlled apparatus terminal device, and registers said read ID code in an internal memory.

6. The system according to claim 5, wherein said controlled apparatus terminal device comprises a single data communication terminal for exchanging signals with the control object or electrical apparatus, and the data communication terminal is used to transmit said generated apparatus control signal to said connected electrical apparatus and to detect the state of the electrical apparatus and the presence of an expanded control function as a function to be controlled regarding a particular item by the system and transmit the state and the presence to said centralized apparatus control device.

7. The system according to claim 1, wherein said controlled apparatus terminal device reads from the control object or electrical apparatus the presence of an expanded control function by which said electrical apparatus can be controlled regarding a particular item by the system, and an expanded control function type indicating the content of the controllable particular item when the electrical apparatus is provided with said expanded control function, and transmits expanded control function information to said centralized apparatus control device, said centralized apparatus control device receives and registers therein said expanded control function information, and controls said control object or electrical apparatus via said controlled apparatus terminal device in accordance with the expanded control function.

8. The system according to claim 7, wherein said controlled apparatus terminal device comprises a single data communication terminal for exchanging signals with the control object or electrical apparatus, and the data communication terminal is used to transmit said generated apparatus control signal to said connected electrical apparatus and to detect the state of the electrical apparatus and the presence of the expanded control function as the function to be controlled regarding the particular item by the system.

9. The system according to claim 1, wherein said centralized apparatus control device comprises an internal clock and a timer, the timer measures a set time, and said control signal is transmitted to said controlled apparatus terminal device corresponding to the control object or electrical apparatus based on time measurement result.

10. The system according to claim 9, wherein said centralized apparatus control device comprises a time information receiver for receiving time information broadcasting, and adjusts time of said internal clock based on received time information.

11. The system according to claim 1, wherein in response to a request, said centralized apparatus control device performs a batch on and/or off control of power supplies of object electrical apparatuses among said plurality of electrical apparatuses via said controlled apparatus terminal devices.

12. The system according to claim 1, further comprising a sensor for detecting a predetermined environment change, and said centralized apparatus control device automatically performing an on and/or off control of the object electrical apparatus via said controlled apparatus terminal device in response to a result of detection by said sensor.

13. The system according to claim 12, wherein after performing the batch off control of the power supplies of said object electrical apparatuses, said centralized apparatus control device resets a timer function set for batch off controlled electrical apparatuses.

14. A system for centrally controlling a plurality of electrical apparatuses comprising:

a centralized apparatus control device and a controlled apparatus terminal device, said controlled apparatus terminal device being registered in said centralized apparatus control device and disposed for each of said plurality of electrical apparatuses as control objects, radio communication being performed between said centralized apparatus control device and said controlled apparatus terminal device registered in the centralized apparatus control device to control the corresponding electrical apparatus via the controlled apparatus terminal device, wherein the controlled apparatus terminal device is provided separately from the electrical apparatuses and is removable therefrom, wherein said controlled apparatus terminal device includes a plurality of terminals formed in at least one integrated circuit which performs a function of the terminal device, wherein the plurality of terminals of the integrated circuit are wire-bonded to a plurality of terminals formed on a circuit mounting board, said plurality of terminals of said integrated circuit include a plurality of code setting terminals for setting individual ID codes, and wherein a terminal corresponding to the ID code assigned to the terminal device among said plurality of code setting terminals of said integrated circuit is wire-bonded to a code setting terminal set at a predetermined electrical potential among said plurality of terminals of said circuit mounting board.

15. The system according to claim 14, wherein said controlled apparatus terminal device further comprises a single data communication terminal for exchanging signals with the control object or electrical apparatus, and the data communication terminal is used to transmit said generated apparatus control signal to said connected electrical apparatus and to detect the state of the electrical apparatus and the presence of an expanded control function as a function to be controlled regarding a particular item by the system.

16. A system for centrally controlling a plurality of electrical apparatuses comprising:

a centralized apparatus control device for controlling an object electrical apparatus by radio communication function;

a controlled apparatus terminal device registered in said centralized apparatus control device for transmitting a predetermined apparatus control signal to the object electrical apparatus based on radio communication with the centralized apparatus control device, wherein the controlled apparatus terminal device is provided separate from the electrical apparatuses and is removable therefrom; and an apparatus power supply control device interposed between said controlled apparatus terminal device and said object electrical apparatus for receiving said apparatus control signal from said controlled apparatus terminal device to control operation power supply to said object electrical apparatus.

17. The system according to claim 16, wherein said apparatus power supply control device comprises:

a switch section for switching conducting and non-conducting of a power supply path between a predetermined operation power supply and said object electrical apparatus;

a switch controller for controlling said switch section; and a detector for detecting conducting or non-conducting state of said power supply path, said switch controller controls said switch section in response to said apparatus control signal from the corresponding controlled apparatus terminal device to control the conducting and non-conducting of said power supply path, and the conducting or non-conducting state of said power supply path detected by said detector is transmitted to said corresponding controlled apparatus terminal device.

18. A system for centrally controlling a plurality of electrical apparatuses comprising:

an centralized apparatus control device for controlling an object electrical apparatus using a radio communication function;

a controlling apparatus terminal device registered in said centralized apparatus control device for transmitting a predetermined apparatus control signal to the object electrical apparatus based on radio communication with the centralized apparatus control device; and an apparatus power supply control device interposed between said controlled apparatus terminal device and said object electrical apparatus for receiving said apparatus control signal from said controlled apparatus terminal device to control operation power supply to said object electrical apparatus, said controlled apparatus terminal device being connected to an electrical apparatus applicable to the system, so that said centralized apparatus control device controls said electrical apparatus applicable to the system via said controlled apparatus terminal device connected to the apparatus, wherein the controlled apparatus terminal device is provided separate from the electrical apparatuses and is removable therefrom, said apparatus power supply control device being connected to an electrical apparatus non-applicable to the system, and said controlled apparatus terminal device being connected to the apparatus power supply control device, so that said centralized apparatus control device controls the electrical apparatus non-applicable to said system via said apparatus power supply control device connected to the apparatus and said controlled apparatus terminal device connected to the apparatus power supply control device.

19. The system according to claim 18, wherein said apparatus power supply control device comprises:

a switch section for switching conducting and non-conducting of a power supply path between a predetermined operation power supply and said object electrical apparatus;

a switch controller for controlling said switch section; and a detector for detecting conducting or non-conducting state of said power supply path, said switch controller controls said switch section in response to said apparatus control signal from the corresponding controlled apparatus terminal device to control the conducting and non-conducting of said power supply path, and the conducting or non-conducting state of said power supply path detected by said detector is transmitted to said corresponding controlled apparatus terminal device.

20. A centralized apparatus control device, used in a system for centrally controlling a plurality of electrical apparatuses via registered controlled apparatus terminal devices by the centralized apparatus control device, for, when said controlled apparatus terminal devices are connected to terminal plug-in sections, reading individual ID codes attached beforehand to said controlled apparatus terminal devices and registering said read ID codes to an internal memory, wherein the controlled apparatus terminal device is provided separate from the electrical apparatuses and is removable therefrom.

21. The centralized apparatus control device according to claim 20 comprising:

an internal clock; and a timer, the timer measuring a set time, an control signal being transmitted to said controlled apparatus terminal device corresponding to the electrical apparatus based on a time measurement result.

22. The centralized apparatus control device according to claim 21, comprising a time information receiver for receiving time information broadcasting, and adjusting time of said internal clock based on received time information.

23. A controlled apparatus terminal device used in a system for centrally controlling a plurality of electrical apparatuses by a centralized apparatus control device and disposed for each electrical apparatus between said plurality of electrical apparatuses as control objects and said centralized apparatus control device for controlling the corresponding electrical apparatus using radio communication with said centralized apparatus control device comprising:

a transmitter/receiver for transmitting a state signal of said corresponding electrical apparatus to said centralized apparatus control device and for receiving a control signal from said centralized apparatus control device; and a terminal controller for generating an apparatus control signal in accordance with said received control signal to transmit the apparatus control signal to said corresponding electrical apparatus and for detecting the state of said connected electrical apparatus to generate said state signal, wherein the controlled apparatus terminal device is provided separate from the electrical apparatuses and is removable therefrom.

24. A controlled apparatus terminal device used in a system for centrally controlling a plurality of electrical apparatuses by a centralized apparatus control device and disposed for each electrical apparatus between said plurality of electrical apparatuses as control objects and said centralized apparatus control device for controlling the corresponding electrical apparatus by radio communication with said centralized apparatus control device, wherein a plurality of terminals are formed in at least one integrated circuit which performs a function of the terminal device, and the plurality of terminals of the integrated circuit are wire-bonded to a plurality of terminals formed on a circuit mounting board, said plurality of terminal of said integrated circuit include a plurality of code setting terminals for setting individual ID codes, and a terminal corresponding to the ID code assigned to the terminal device among said plurality of code setting terminals of said integrated circuit is wire-bonded to a code setting terminal set at a predetermined electric potential among said plurality of terminals of said circuit mounting board, wherein the controlled apparatus terminal device is provided separate from the electrical apparatuses and is removable therefrom.

25. The controlled apparatus terminal device according to claim 24, wherein a presence of an expanded control function by which the control object or electrical apparatus can be controlled regarding a particular item by the system and an expanded control function type indicating the content of the controllable particular item when the electrical apparatus is provided with said expanded control function are read from said electrical apparatus, and expanded control function information is transmitted to said centralized apparatus control device.

26. The controlled apparatus terminal device according to claim 25, further comprising:

a single data communication terminal for exchanging signals with the control object or electrical apparatus, the data communication terminal is used to transmit said generated apparatus control signal to said connected electrical apparatus and to detect the state of the electrical apparatus and the presence of the expanded control function as a function to be controlled regarding a particular item by the system.

27. An apparatus power supply control device for use in a system for centrally controlling a plurality of electrical apparatuses via controlled apparatus terminal devices by an centralized apparatus control device, interposed between a control object or electrical apparatus and the controlled apparatus terminal device registered in said centralized apparatus control device for outputting a predetermined apparatus control signal for controlling said control object or electrical apparatus based on radio communication with said centralized apparatus control device, for receiving said apparatus control signal from said controlled apparatus terminal device to control operation power supply to said control object or electrical apparatus, wherein the controlled apparatus terminal device is provided separate from the electrical apparatuses and is removable therefrom.

28. The apparatus power supply control device according to claim 27 comprising:

a switch section for switching conducting and non-conducting of a power supply path between a predetermined operation power supply and said control object or electrical apparatus;

a switch controller for controlling said switch section; and a detector for detecting a conducting or non-conducting state of said power supply path, said switch controller controlling said switch section in response to said apparatus control signal from the corresponding controlled apparatus terminal device to control the conducting and non-conducting of said power supply path, the conducting or non-conducting state of said power supply path detected by said detector being transmitted to said corresponding controlled apparatus terminal device.

29. A semiconductor device constituted by wire-bonding a plurality of terminals formed on an integrated circuit to a plurality of terminals formed on a circuit mounting board, said plurality of terminals of said integrated circuit including a plurality of code setting terminals for setting individual ID codes, a terminal corresponding to a predetermined ID code among said plurality of code setting terminals of said integrated circuit being wire-bonded to a code setting terminal set at a predetermined electrical potential among said plurality of terminals of said circuit mounting board.

* * * * *